US009552782B2

(12) United States Patent
Kobayashi

(10) Patent No.: US 9,552,782 B2
(45) Date of Patent: Jan. 24, 2017

(54) IMAGE DISPLAY DEVICE, PRESENTATION BOX EMPLOYING SAME, AND METHOD OF DRIVING IMAGE DISPLAY DEVICE

(71) Applicant: Sharp Kabushiki Kaisha, Osaka-shi, Osaka (JP)

(72) Inventor: Masamitsu Kobayashi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 44 days.

(21) Appl. No.: 14/391,845

(22) PCT Filed: Apr. 10, 2013

(86) PCT No.: PCT/JP2013/060782

§ 371 (c)(1),
(2) Date: Oct. 10, 2014

(87) PCT Pub. No.: WO2013/154123

PCT Pub. Date: Oct. 17, 2013

(65) Prior Publication Data

US 2015/0103107 A1 Apr. 16, 2015

(30) Foreign Application Priority Data

Apr. 11, 2012 (JP) ..... 2012-090522

(51) Int. Cl.
*G09G 3/36* (2006.01)
*G09G 3/34* (2006.01)

(52) U.S. Cl.
CPC ..... *G09G 3/3607* (2013.01); *G09G 3/346* (2013.01); *G09G 3/3413* (2013.01);
(Continued)

(58) Field of Classification Search
None
See application file for complete search history.

(56) References Cited

U.S. PATENT DOCUMENTS

2004/0105053 A1 6/2004 Ozeki et al.
2009/0015525 A1 1/2009 Hosaka et al.
(Continued)

FOREIGN PATENT DOCUMENTS

JP H10254390 A 9/1998
JP 2004157492 A 6/2004
(Continued)

OTHER PUBLICATIONS

Chi-Chung Tsai, et al. "A Window LCD Achieved by Color-Sequential Methods", SID 11 Digest, p. 74-77.
(Continued)

*Primary Examiner* — David D Davis
(74) *Attorney, Agent, or Firm* — Harness, Dickey & Pierce, P.L.C.

(57) ABSTRACT

An image display device is capable of displaying an image, in which occurrence of color unevenness is suppressed. A method of driving the image display device is also disclosed. In an area above the dotted line, red light is transmitted in a first sub-frame period. In second and third sub-frame periods, light blocking data are respectively supplied as green data and blue data. Therefore, green light and blue light cannot be transmitted through the area. Hence, a red image with no color unevenness is displayed in the area. In contrast, in an area under the dotted line, the red light is transmitted in the first sub-frame period, and the green light is transmitted in the second sub-frame period. As a result, in a viewed image of the area, there is color unevenness where green is mixed to red.

13 Claims, 29 Drawing Sheets

(52) U.S. Cl.
CPC ..... *G09G 3/3426* (2013.01); *G09G 3/3677* (2013.01); *G09G 3/3648* (2013.01); *G09G 2310/024* (2013.01); *G09G 2310/0235* (2013.01); *G09G 2310/08* (2013.01); *G09G 2320/0233* (2013.01); *G09G 2320/0242* (2013.01); *G09G 2320/0646* (2013.01); *G09G 2380/00* (2013.01)

(56) References Cited

U.S. PATENT DOCUMENTS

| | | | | |
|---|---|---|---|---|
| 2009/0128552 | A1* | 5/2009 | Fujiki | G06T 15/06 345/419 |
| 2012/0314902 | A1* | 12/2012 | Kimura | G06F 3/017 382/103 |
| 2013/0265218 | A1* | 10/2013 | Moscarillo | G06F 3/017 345/156 |
| 2014/0327611 | A1* | 11/2014 | Ono | G06F 3/0425 345/156 |

FOREIGN PATENT DOCUMENTS

| | | | |
|---|---|---|---|
| JP | 2009-020385 | A | 1/2009 |
| JP | 2009042446 | A | 2/2009 |
| JP | 2012043611 | A | 3/2012 |

OTHER PUBLICATIONS

International Search Report PCT/ISA/210 for International Application No. PCT/JP2013/060782 Dated Jul. 9, 2013.

* cited by examiner (a)

(b)

(a)

(b)

(a)

(b)

IMAGE DISPLAY DEVICE, PRESENTATION BOX EMPLOYING SAME, AND METHOD OF DRIVING IMAGE DISPLAY DEVICE

TECHNICAL FIELD

The present invention relates to an image display device, a presentation box employing the same, and a method of driving the image display device. More specifically, the present invention relates to an image display device that is driven using a field sequential system, a presentation box employing the same, and a method of driving the image display device.

BACKGROUND ART

In recent years, the field sequential system as one of driving systems of a liquid crystal, display device, which displays a color image, has been developed. In the field sequential system, by sequentially switching light emitting elements such as cathode fluorescent lamps (CCFL) and light emitting diodes (LED) of red (R) light, green (G) light, and blue (B) light as light of a backlight and by sequentially supplying color data corresponding to colors of light of the respective light emitting elements to a liquid crystal panel in synchronization with the switching, transmission states thereof are controlled, whereby additive color mixing is performed on the retinas of an observer. According to the field sequential system, colors can be displayed even when a plurality of sub-pixels are not formed on a single pixel. Therefore, it is possible to achieve high resolution. Further, since the light from each light emitting element is directly used, it is not necessary to form a color filter in each pixel (color-filterless), and usage efficiencies of light of the respective light emitting elements are improved.

When an image is displayed on the liquid crystal panel through the field sequential system, for each sub-frame period, the light emitting elements provided in a backlight unit are sequentially switched, and a scanning operation is performed from the upper end to the lower end (or from the lower end to the upper end) of the screen.

For example, a description will be given of a case of displaying a red image on the liquid crystal panel through field sequential driving disclosed in PTL 1. FIG. 29 is a diagram illustrating display states of an image in respective sub-frame periods when an image is displayed on the liquid crystal panel through a field sequential system in the related art. More specifically, FIG. 29(*a*) is a diagram illustrating timing of supplying data for red image display to each pixel of the liquid crystal panel, and FIG. 29(*b*) is a diagram illustrating lighting start times and lighting time periods of light emitting elements of respective colors.

As illustrated in FIG. 29(*a*), a red light emitting element is turned on from a start time to an end time in a first sub-frame period. Further, the scanning operation from the upper end to the lower end of a screen is started at the start time, and transmission data (an opening portion indicated in FIG. 29(*a*)), which is for maximizing an amount of transmitted red light, is supplied as red data to each pixel. Thereby, the red light is transmitted through an area to which the red transmission data is supplied.

The red light emitting element is turned on from the start time to the end time in a second sub-frame period. Further, the scanning operation from the upper end to the lower end of a screen is started at the start time, and light blocking data (a hatched portion indicated in FIG. 29(*a*)), which is for minimizing the amount of transmitted red light, is supplied as red data to each pixel. Thereby, the red light is transmitted through an area in which the red transmission data remains.

The green light emitting element is turned on from the start time to the end time in a third sub-frame period. Further, the scanning operation from the upper end to the lower end of a screen is started at the start time, and light blocking data, which is for minimizing the amount of transmitted green light, is supplied as green data to each pixel. Thereby, light blocking data is supplied to all the pixels, and thus the green light cannot be transmitted through the liquid crystal panel.

Likewise, also in a fourth sub-frame period, the green light cannot be transmitted through the liquid crystal panel. Further, also in a fifth sub-frame period and a sixth sub-frame period, the blue light cannot be transmitted through the liquid crystal panel. Thereby, as illustrated in FIG. 29(*b*), a red image with no color unevenness is displayed on the liquid crystal panel.

Further, there is a presentation box described in NPL 1 as an application example of the image display device that displays an image on the liquid crystal panel through the above-mentioned field sequential system. On the front surface of the presentation box, a color-filterless liquid crystal panel is provided. An illumination unit, which illuminates the inside of the presentation box, employs red, green, and blue LEDs or CCFLs. In a similar manner to the liquid crystal display device disclosed in PTL 1, by appropriately controlling the light emitting timing of the illumination unit and the timing of controlling the transmission state of the liquid crystal panel, red light, green light, and blue light emitted from the illumination unit are respectively transmitted through the liquid crystal panel in accordance with the transmission states of the liquid crystal panel. Thereby, an observer, who is observing the presentation box, is able to view not only a color image, which is displayed on the liquid crystal panel provided on the front surface of the presentation box, but also an exhibited object which is exhibited inside the presentation box.

CITATION LIST

Patent Literature

PTL 1: Japanese Unexamined Patent Application Publication No. 10-254390

Non Patent Literature

NPL 1: Chi-Chung Tsai, four others, "A Window LCD Achieved by Color-Sequential Methods", SID 11 DIGEST, p. 74-77

SUMMARY OF INVENTION

Technical Problem

However, when an image is displayed on the liquid crystal panel in accordance with the field sequential method described in PTL 1, it is necessary to perform the scanning operation at a speed which is twice that in the related art. Thereby, the load on the driving circuit for driving the liquid crystal panel increases, and image data has to be supplied to each pixel in a short time period. Hence, it is difficult to secure a time period therefor.

Further, in the presentation box described in NPL 1, the position of the exhibited object arranged in the presentation box can be determined in consideration of a dramatic effect of the exhibited object and the like. Accordingly, there is a case where although an observer wants to view both of a color image, which is displayed on the front surface of the presentation box, and the exhibited object, the observer may not see the exhibited object if the exhibited object is behind the color image.

Accordingly, an object of the present invention is to provide an image display device capable of displaying an image, in which occurrence of color unevenness is suppressed, while reducing load on a driving circuit and securing a time period necessary for supplying data for image display, and a method of driving the image display device. Further, another object of the present invention is to provide a presentation box with which an observer is able to view both of an image and an exhibited object regardless of the position of the exhibited object arranged in the presentation box.

Means for Solving the Problems

A first aspect of the invention is an image display device that displays an image with a desired color by dividing a single frame period of a supplied input signal into a plurality of sub-frame periods and sequentially performing a scanning operation on single or multiple color data for each sub-frame period, the image display device including: a display panel that includes a display area for displaying the image with the desired color by receiving the single or multiple color data generated on the basis of the input signal, for each sub-frame period; an illumination unit that emits single or multiple color light of a backlight generated on the basis of light source luminance data, from a rear surface side of the display panel for each sub-frame period; and an image control circuit that generates the single or multiple color data on the basis of the input signal and acquires a light source lighting time period, by which a lighting time period of the illumination unit is designated, and a timing control signal for controlling at least one of a lighting start time of the illumination unit and a start time of the scanning operation, in which the image control circuit supplies the single or multiple color data to the display panel by performing the scanning operation for each sub-frame period, controls the light source lighting time period of the illumination unit which emits the single or multiple color light of the backlight corresponding to the single or multiple color data, for each of periods corresponding to periods, in which only the single or multiple color data necessary for display of the image with the desired color is supplied, in the sub-frame periods, and controls at least one of the lighting start time of the illumination unit and the start time of the scanning operation.

According to a second aspect of the invention, in the first aspect of the invention, the display panel further includes a non-display area on which an image including a color other than the desired color is displayed, and the single or multiple color data supplied to the non-display area for each sub-frame period is data which is the same for each pixel.

According to a third aspect of the invention, in the first or second aspect of the invention, the scanning operation is at least one of a scanning operation, which starts later than the start time of the sub-frame period, and a scanning operation which ends earlier than the end time of the sub-frame period.

According to a fourth aspect of the invention, in the first aspect of the invention, when response time period designation data is supplied, the image control circuit acquires the light source lighting time period by further using the response time period designation data, where the response time period designation data indicates a time period until transmittance corresponding to the single or multiple color data is reached after the single or multiple color data is supplied.

According to a fifth aspect of the invention, in the second aspect of the invention, the image control circuit acquires the single or multiple color data to be supplied to each of the display area and the non-display area, on the basis of field sequential image data for displaying an image for each sub-frame period on the basis of the input signal, display start position designation data for designating a display start position of the display area, and non-display start position designation data for designating a display start position of the non-display area.

According to a sixth aspect of the invention, in the second aspect of the invention, the image control circuit includes a field sequential processing circuit that generates field sequential image data for displaying an image for each sub-frame period by using the single or multiple color data included in the input signal, a lighting ratio processing circuit that acquires the light source lighting time period, by which a lighting time period of the illumination unit is designated, and the light source luminance data of the light of the backlight, on the basis of display start position designation data for designating a display start position of the display area and non-display start position designation data for designating a display start position of the non-display area, a lighting timing processing circuit that acquires the timing control signal for controlling at least one of the lighting start time of the illumination unit and the start time of the scanning operation, on the basis of the light source lighting time period and the display start position designation data, and a display image generation circuit that generates the single or multiple color data to be supplied to each of the display area and the non-display area on the basis of the field sequential image data, the display start position designation data, and the non-display start position designation data.

According to a seventh aspect of the invention, in the sixth aspect of the invention, the input signal further includes the display start position designation data and the non-display start position designation data, the image control circuit further includes a signal separation circuit which is connected to the field sequential processing circuit, the lighting ratio processing circuit, the lighting timing processing circuit, and the display image generation circuit, and the signal separation circuit separates the single or multiple color data, the display start position designation data, and the non-display start position designation data, from the input signal.

According to an eighth aspect of the invention, in the seventh aspect of the invention, the input signal further includes response time period designation data which indicates a time period until transmittance corresponding to the single or multiple color data is reached after the single or multiple color data is supplied to the display panel, the signal separation circuit further separates the response time period designation data from the input signal and supplies the response time period designation data to the lighting ratio processing circuit, and the lighting ratio processing circuit acquires the light source lighting time period by using the display start position designation data, the non-display start position designation data, and the response time period designation data.

According to a ninth aspect of the invention, in the sixth aspect of the invention, the image control circuit further includes a memory which is connected to the lighting ratio processing circuit, the lighting timing processing circuit, and the display image generation circuit, and stores the display start position designation data and the non-display start position designation data, the lighting ratio processing circuit reads the display start position designation data and the non-display start position designation data from the memory in order to acquire the light source lighting time period, the lighting timing processing circuit reads the display start position designation data from the memory in order to acquire the timing control signal, and the display image generation circuit reads the display start position designation data and the non-display start position designation data from the memory in order to generate the single or multiple color data to be supplied to each of the display area and the non-display area.

According to a tenth aspect of the invention, in the ninth aspect of the invention, the memory further stores response time period designation data which indicates a time period until transmittance corresponding to the single or multiple color data is reached after the data for displaying a single or multiple color image is supplied, and the lighting ratio processing circuit reads the display start position designation data, the non-display start position designation data, and the response time period designation data, from the memory, and acquires the light source lighting time period.

According to an eleventh aspect of the invention, in the second aspect of the invention, the image control circuit includes means for acquiring field sequential image data for displaying an image for each sub-frame period on the basis of the input signal, means for acquiring at least one of the light source lighting time period, by which a lighting time period of the illumination unit is designated, and the light source luminance data of the light of the backlight, on the basis of display start position designation data for designating a display start position of the display area, non-display start position designation data for designating a non-display start position of the non-display area, and the field sequential image data, means for acquiring the timing control signal for controlling at least one of the lighting start time of the illumination unit and the start time of the scanning operation on the basis of the display start position designation data and the light source lighting time period, and means for generating the single or multiple color data on the basis of the field sequential image data, the display start position designation data, and the non-display start position designation data.

According to a twelfth aspect of the invention, in the eleventh aspect of the invention, the means for acquiring the light source lighting time period includes first comparison means for comparing magnitudes of the display start position designation data and the non-display start position designation data, and means for calculating the light source lighting time period through a calculation expression in accordance with a comparison result obtained by the comparison means.

According to a thirteenth aspect of the invention, in the eleventh aspect of the invention, the means for generating the single or multiple color data includes second comparison means for comparing magnitudes of the display start position designation data and the non-display start position designation data, and means for specifying a display position of the image by generating the single or multiple color data to be supplied to each of the display area and the non-display area on the basis of a comparison result obtained by the second comparison means.

According to a fourteenth aspect of the invention, in the thirteenth aspect of the invention, the image display device further includes means for displaying the image in a delayed manner, in which when the non-display start position designation data is smaller than the display start position designation data and is not zero, the means for displaying the image in a delayed manner outputs the single or multiple color data, which has the display start position designation data smaller than the non-display start position designation data, with a delay of a single sub-frame period.

A fifteenth aspect of the invention is a presentation box including the image display device according to any one of the first to fourteenth aspects.

A sixteenth aspect of the invention is a method of driving an image display device that displays an image with a desired color by dividing a single frame period of a supplied input signal into a plurality of sub-frame periods and sequentially performing a scanning operation on single or multiple color data for each sub-frame period, in which the image display device includes a display panel that includes a display area for displaying the image with the desired color by receiving the single or multiple color data generated on the basis of the input signal, for each sub-frame period, an illumination unit that emits single or multiple color light of a backlight generated on the basis of light source luminance data, from a rear surface side of the display panel for each sub-frame period, and an image control circuit that generates the single or multiple color data on the basis of the input signal and acquires a light source lighting time period, by which a lighting time period of the illumination unit is designated, and a timing control signal for controlling at least one of a lighting start time of the illumination unit and a start time of the scanning operation, in which the method includes: a step of performing a scanning operation for supplying the single or multiple color data to the display panel for each sub-frame period; and a step of sequentially emitting the light of the backlight from the rear surface side of the display panel for each sub-frame period by controlling the light source lighting time period of the illumination unit which emits the single or multiple color light of the backlight corresponding to the single or multiple color data, for each of periods corresponding to periods, in which only the single or multiple color data necessary for display of the image with the desired color is supplied, in the sub-frame periods and controlling at least one of the lighting start time of the illumination unit and the start time of the scanning operation.

According to a seventeenth aspect of the invention, in the sixteenth aspect of the invention, the display panel further includes a non-display area on which an image including a color other than the desired color is displayed, and in which the step of performing the scanning operation further includes a step of supplying the same data for each pixel.

According to an eighteenth aspect of the invention, in the sixteenth or seventeenth aspect of the invention, the step of performing the scanning operation further includes at least one of a step of starting the scanning operation later than the start time of the sub-frame period, and a step of ending the scanning operation earlier than the end time of the sub-frame period.

According to a nineteenth aspect of the invention, in the sixteenth aspect of the invention, the step of sequentially emitting the light of the backlight further includes a step of acquiring the light source lighting time period by using response time period designation data when the response time period designation data is supplied, where the response time period designation data indicates a time period until transmittance corresponding to the single or multiple color data is reached after the single or multiple color data is supplied.

According to a twentieth aspect of the invention, in the seventeenth aspect of the invention, the step of performing the scanning operation includes a step of acquiring the single or multiple color data to be supplied of each of the display area and the non-display area on the basis of field sequential image data for displaying an image for each sub-frame period on the basis of the input signal, display start position designation data for designating a display start position of the display area, and non-display start position designation data for designating a display start position of the non-display area.

Advantages of the Invention

According to the first aspect of the invention, the control is performed on the light source lighting time period of the illumination unit and at least one of the lighting start time of the illumination unit and the start time of the scanning operation such that the single or multiple color light of the backlight corresponding to the single or multiple color data is emitted, for each of periods corresponding to periods, in which only the single or multiple color data necessary for display of the image with the desired color is supplied, in the sub-frame periods. Thereby, it is possible to set the display area, which is for displaying the image with the desired color in which occurrence of color unevenness is suppressed, at an arbitrary position on the display panel. Further, in the period in which the same color light of the backlight is emitted, the number of the scanning operations performed is only one. Therefore, it is possible to reduce the load on the driving circuit, and it is possible to secure the time period necessary for the single or multiple color data to be supplied.

According to the second aspect of the invention, the single or multiple color data supplied to the non-display area for each sub-frame period is the same data. Hence, in the non-display area, occurrence of color unevenness is suppressed.

According to the third aspect of the invention, by performing the scanning operation earlier or later than the start time of the sub-frame period, it is possible to widen the display area capable of displaying the image in which occurrence of color unevenness is suppressed, and it is possible to increase the luminance of the image in which occurrence of color unevenness is suppressed.

According to the fourth aspect of the invention, when the response time period designation data is supplied, the light source lighting time period is acquired further using the response time period designation data. The data indicates a time period after the single or multiple color data is supplied to the display panel until transmittance corresponding to the supplied data is reached. Thereby, since the light source lighting time period is appropriately designated, the image display device is able to display an image, in which occurrence of color unevenness is further suppressed, in the display area.

According to the fifth aspect of the invention, the single or multiple color data to be supplied to each of the display area and non-display area can be acquired on the basis of the field sequential image data for displaying an image for each sub-frame period, the display start position designation data, and the non-display start position designation data. Thereby, the image display device is able to easily and reliably generate the data for image display to be supplied to the display area and non-display area.

According to the sixth aspect of the invention, the image control circuit includes: the lighting ratio processing circuit that acquires the light source lighting time period in which the illumination unit is turned on; a lighting timing processing circuit that acquires the timing control signal for controlling at least one of the lighting start time of the light source and the start time of the scanning operation; and a display image generation circuit that acquires the single or multiple color data to be supplied to the display area and non-display area. Thereby, the image display device is able to easily and reliably display an image, in which occurrence of color unevenness is suppressed, in the display area.

According to the seventh aspect of the invention, the image control circuit includes a signal processing circuit that separates the display start position designation data and the non-display start position designation data, from the input signal which includes the display start position designation data and the non-display start position designation data. Thereby, at the time of generating the input signal, it is possible to easily change the display start position designation data and the non-display start position designation data. Hence, the image display device is able to set the display area capable of displaying an image, in which occurrence of color unevenness is suppressed, at an arbitrary position on the display panel by changing the display start position designation data and the non-display start position designation data.

According to the eighth aspect of the invention, the response time period designation data is also included in the input signal, and is separated by the signal separation circuit. Thereby, it is possible to easily change the response time period designation data, and thus it is possible to set a response time period optimum for the display panel to be used. Hence, the light source lighting time period is appropriately designated, and thus the image display device is able to display an image, in which occurrence of color unevenness is further suppressed, in the display area.

According to the ninth aspect of the invention, the image control circuit stores the display start position designation data and the non-display start position designation data in the memory provided therein. Thereby, it is possible to easily change the display start position designation data and the non-display start position designation data. Hence, the image display device is able to set the display area capable of displaying an image, in which occurrence of color unevenness is suppressed, at an arbitrary position on the display panel by changing these data.

According to the tenth aspect of the invention, the image control circuit also stores the response time period designation data in the memory. Thereby, it is possible to easily change the response time period designation data, and thus it is possible to set a response time period optimum for the used display panel. Hence, the light source lighting time period is appropriately designated, and thus the image display device is able to display an image, in which occurrence of color unevenness is further suppressed, in the display area.

The eleventh aspect of the invention has the same advantages as the eighth aspect of the invention.

According to the twelfth aspect of the invention, it is possible to easily and promptly acquire the light source lighting time period through the calculation expression in accordance with the magnitude relationship between the display start position designation data and the non-display start position designation data. Thereby, the light source lighting time period is appropriately designated, and thus the image display device is able to display an image, in which occurrence of color unevenness is further suppressed, in the display area.

According to the thirteenth aspect of the invention, by comparing the magnitudes of the display start position designation data and the non-display start position designation data, the single or multiple color data to be supplied to each of the display area and non-display area is easily and promptly acquired, or the display position is easily and promptly designated. Thereby, the image display device is able to easily and promptly display an image, in which occurrence of color unevenness is suppressed, in the display area.

According to the fourteenth aspect of the invention, when the non-display start position designation data is smaller than the display start position designation data and is not zero, the single or multiple color data, which has the display start position designation data smaller than the non-display start position designation data, is output with a delay of a single sub-frame period. Thereby, the image display device is able to display an image, in which occurrence of color unevenness is suppressed, in the display area which is designated on the basis of the display start position designation data smaller than the non-display start position designation data.

According to the fifteenth aspect of the invention, an exhibited object is put in the presentation box using the image display device according to the first to fifteenth aspects of the invention. Thereby, the presentation box is able to display an image with no color unevenness in the display area on the display panel, or is able to provide an exposition for the exhibited object. Further, the data for maximizing the amount of transmitted light, which is emitted from the illumination unit, is supplied to the non-display area. Thereby, it becomes easy for an observer to observe the exhibited object within the presentation box. On the other hand, the light blocking data for minimizing the amount of transmitted light is supplied to the non-display area. Thereby, an observer is able to observe only the exhibited object.

The sixteenth aspect of the invention has the same advantages as the first aspect of the invention.

The seventeenth aspect of the invention has the same advantages as the second aspect of the invention.

The eighteenth aspect of the invention has the same advantages as the third aspect of the invention.

The nineteenth aspect of the invention has the same advantages as the fourth aspect of the invention.

The twentieth aspect of the invention has the same advantages as the fifth aspect of the invention.

BRIEF DESCRIPTION OF DRAWINGS

FIG. 5 is a diagram illustrating a relationship between a distance from the end of a source electrode and distribution of carrier concentration in an oxide semiconductor layer, in the TFT illustrated in FIG. 1.

DESCRIPTION OF EMBODIMENTS

1. Basic Study

Various studies had been performed on a method of driving a liquid crystal display device in a case of displaying a red image on a liquid crystal panel while reducing load on a driving circuit and securing a time period necessary for supplying image data. Therefore, the study results will be described. In the present description, the case of displaying the red image on the liquid crystal panel, is exemplified. However, the present invention is not limited to this, and is also applied to a case of displaying an image including any two colors or all colors of three colors of red, green, and blue, in a similar manner. Further, in a similar manner, the present invention may also be applied to not only the field sequential driving of sequentially displaying red, green, and blue images but also other field sequential driving such as field sequential driving of sequentially displaying images of cyan (C), magenta (M), and yellow (Y).

<1.1 First Driving Method>

Figure 1:
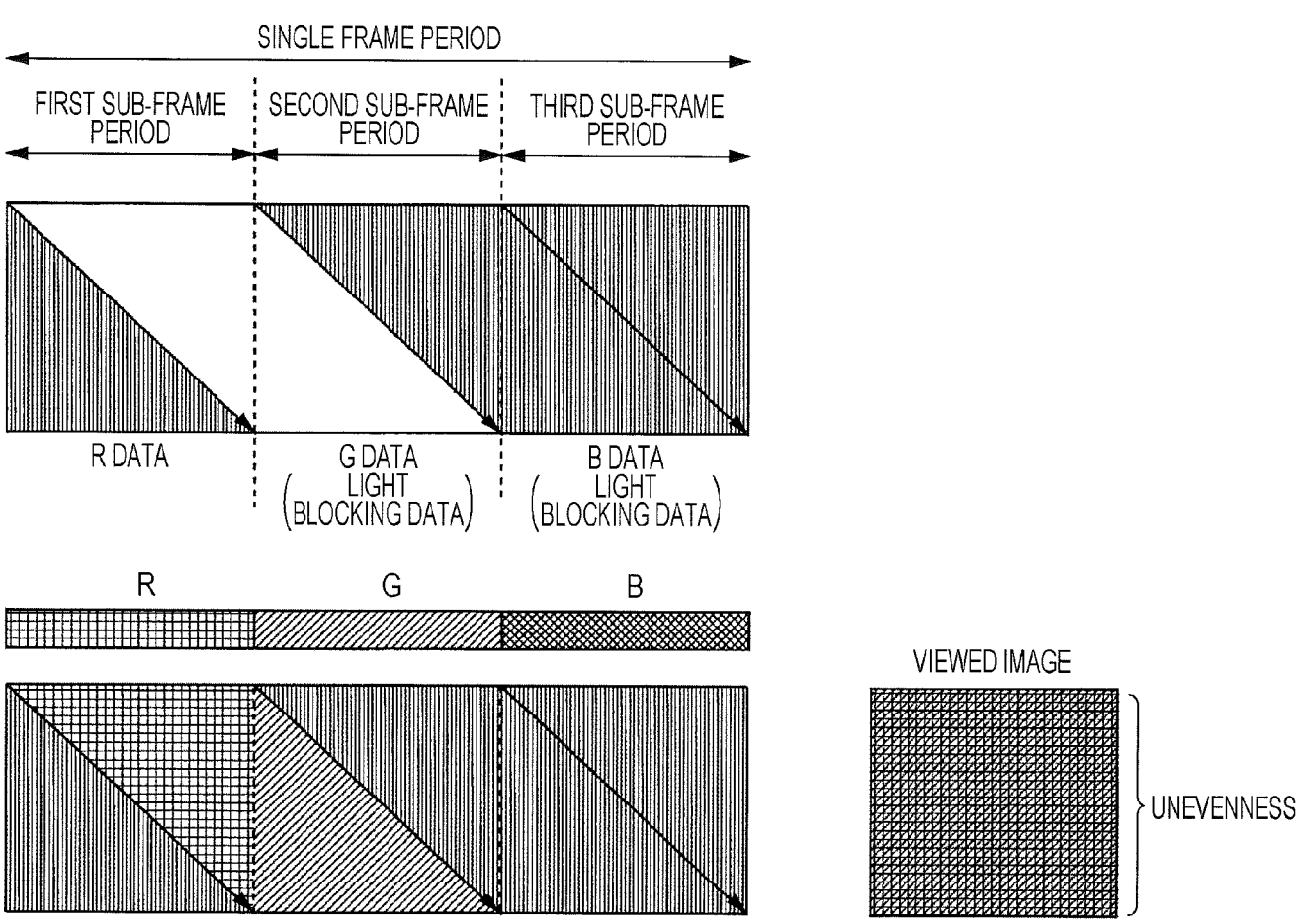
FIG. 1 is a diagram illustrating timing of displaying of a red image on a liquid crystal panel. More specifically, FIG. 1(*a*) is a diagram illustrating timing of supplying data for red image display to the liquid crystal panel, and FIG. 1(*b*) is a diagram illustrating lighting start times and lighting time periods of light emitting elements of respective colors.

FIG. 1 is a diagram illustrating timing of displaying of a red image on a liquid crystal panel. More specifically, FIG. 1(*a*) is a diagram illustrating timing of supplying data for red image display to the liquid crystal panel, and FIG. 1(*b*) is a diagram illustrating lighting start times and lighting time periods of light emitting elements of respective colors. In FIGS. 1(*a*) and 1(*b*), the horizontal axis indicates a time period, and the vertical axis indicates a length of the liquid crystal panel in the vertical direction. In the present description, it is assumed that a single frame period is formed of three sub-frame periods. In addition, the arrows illustrated in FIGS. 1(*a*) and 1(*b*) indicate scanning operations.

Here, the "red image" in the present description is defined. The "red image" is defined as an image in which the luminance of red is at the maximum. In the field sequential driving formed of three sub-frames of red, green, and blue, the "red image" means an image which is formed when red data (hereinafter referred to as "transmission data") for maximizing the amount of transmitted red light is supplied and image data (hereinafter referred to as light blocking data) for minimizing the amount of transmitted green and blue light is supplied as green and blue data. Further, when a white object is present on the rear side of the liquid crystal panel in a straight line connecting the eyes of an observer and an area in which an image on the liquid crystal panel is displayed, the "red image" means that a white object is viewed as a red object through the liquid crystal panel since light originating from the light source is sufficiently diffused through reflection or transmission.

Figure 28:
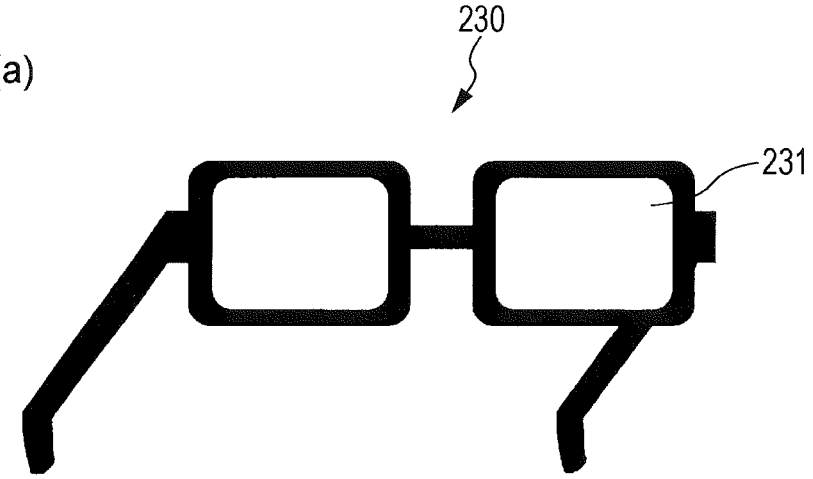
FIG. 28 is a diagram illustrating the second application example of the present invention. More specifically, FIG. 28(*a*) illustrates glasses as an application of the present invention, and FIG. 28(*b*) illustrates a tablet as an application of the present invention.
Figure 28:
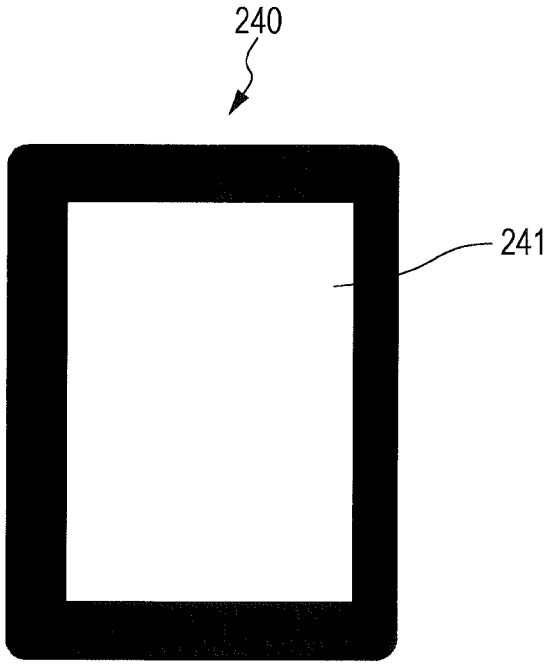
Figure 29:
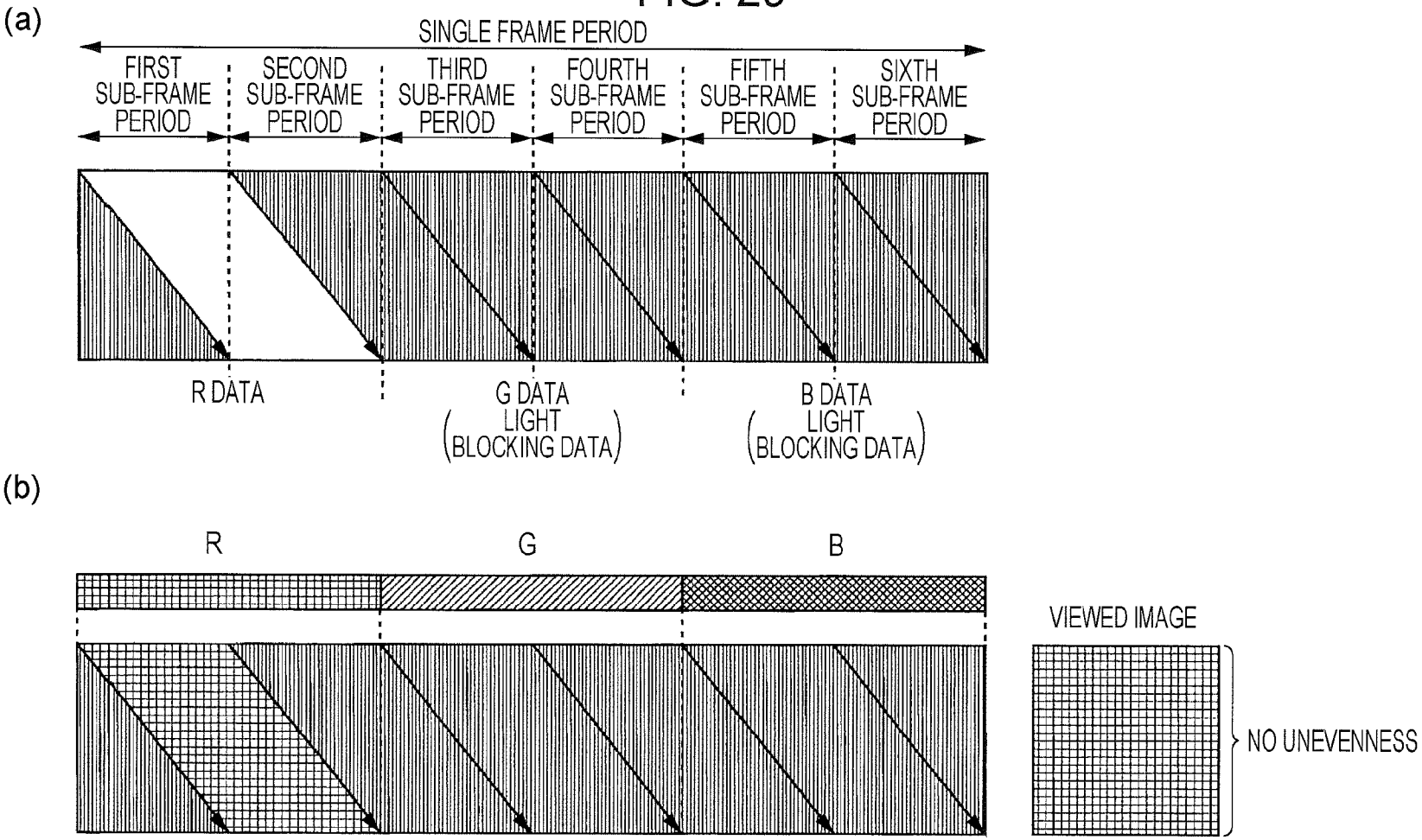
FIG. 29 is a diagram illustrating display states of an image in respective sub-frame periods when an image is displayed on the liquid crystal panel through a field sequential system in the related art. More specifically, FIG. 29(*a*) is a diagram illustrating timing of supplying data for red image display to each pixel of the liquid crystal panel, and FIG. 29(*b*) is a diagram illustrating lighting start times and lighting time periods of light emitting elements of respective colors.

When the scanning operation is performed once for each sub-frame period, compared with the case illustrated in FIG. 28, the load on the driving circuit is reduced, and it is possible to secure the time period for supplying the image data to each pixel. In this case, the study addresses what image is displayed on the screen.

In a first sub-frame period, as illustrated in FIG. 1(*a*), the scanning operation from the upper end to the lower end of the screen is performed from the start time, and transmission data, which is for maximizing the amount of transmitted light originating from the light emitting element, is sequentially supplied as red data to each pixel. At the end time of the period, the transmission data, which is for maximizing the amount of transmitted light originating from the light emitting element, is supplied as red data to the pixel at the lower end. Further, as illustrated in FIG. 1(*b*), the red light emitting element is turned on at the start time of the first sub-frame period, and is turned off at the end time thereof.

Next, in a second sub-frame period, as illustrated in FIG. 1(*a*), the scanning operation from the upper end to the lower end of the screen is performed from the start time, and light blocking data, which is for minimizing the amount of transmitted light originating from the light emitting element, is supplied as green data to each pixel. Further, the green light emitting element is turned on at the start time of the second sub-frame period, and is turned off at the end time thereof. Since the scanning operation is performed from the upper end to the lower end of the screen, the time period, which elapses before the light blocking data instead of the transmission data is supplied to each pixel on the lower side of the screen, is longer, and the red data remains until the end thereof. Further, as illustrated in FIG. 1(*b*), the green light emitting element is turned on from the start time of the second sub-frame data to the end time thereof. Even when the green light emitting element is turned on, in the pixels on the upper side of the screen, the light blocking data instead of the transmission data is supplied in a short time period, and thus the amount of green light transmitted through the pixels is small. However, in the pixels on the lower side of the screen, the time period, which elapses before the light blocking data is supplied, is longer, and the amount of green light transmitted through the pixels during the time period is higher. As a result, an image (viewed image), which is displayed on the screen, is displayed in red on the upper side of the screen, but green is increasingly mixed therewith at a lower position, whereby color unevenness or luminance unevenness occurs. The reason for this is that, since the time period, which elapses before the light blocking data instead of the transmission data is supplied through the scanning operation, is different for each pixel, the time period of transmission of the green light transmitted through pixels, to which the transmission data is supplied, is longer at the lower position on the screen.

In addition, although the image displayed on the lower side of the screen is originally displayed in red, a large amount of green light is included therein. Hence, color unevenness occurs in the image. From another viewpoint, it may be said that, since the amount of green light having an effect on the luminance is different between the pixels on the upper side and the pixels on the lower side of the screen, luminance unevenness occurs in the image displayed on the screen. Accordingly, in the present description, such unevenness is referred to as "color unevenness".

In addition, in a third sub-frame period, the light blocking data is supplied to all the pixels from the start time, and thus blue light is not transmitted through the pixels during lighting of the blue light emitting element. Thereby, color unevenness, which is caused when blue is mixed with the red image, does not occur.

Next, study of a driving method for suppressing such color unevenness, which occurs when the red image is displayed, will be described.

<1.2 Second Driving Method>

Figure 2:
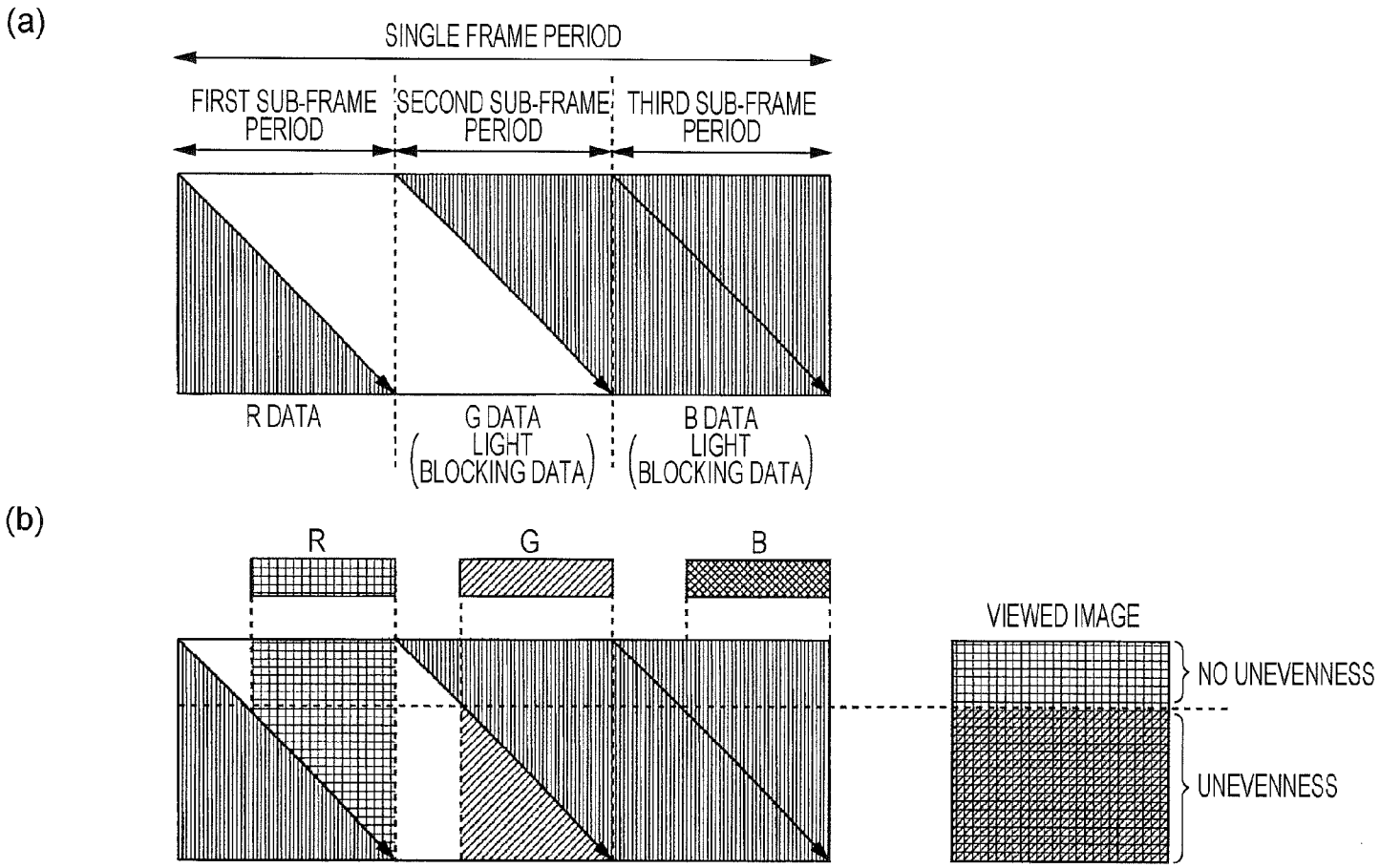
FIG. 2 is a diagram illustrating a driving method of displaying a red image with less color unevenness through field sequential driving. More specifically, FIG. 2(*a*) is a diagram illustrating timing of supplying data for red image display to the liquid crystal panel, and FIG. 2(*b*) is a diagram illustrating lighting start times and lighting time periods of light emitting elements of respective colors.

FIG. 2 is a diagram illustrating a driving method of displaying a red image with less color unevenness through field sequential driving. More specifically, FIG. 2(*a*) is a diagram illustrating timing of supplying data for red image display to the liquid crystal panel, and FIG. 2(*b*) is a diagram illustrating lighting start times and lighting time periods of light emitting elements of respective colors.

As illustrated in FIG. 2(*a*), in the first sub-frame period, the scanning operation is started from the upper side of the screen, and the transmission data is supplied as red data to each pixel. Further, the red light emitting element is turned on when a predetermined time period has elapsed from the start time of the first sub-frame period, and is turned off at the end time thereof.

Next, in the second sub-frame period, the scanning operation is started from the upper side of the screen, and the light blocking data is supplied as green data to each pixel. Further, the green light emitting element is turned on when a predetermined time period has elapsed from the start time of the second sub-frame period, and is turned off at the end time thereof.

Likewise, in the third sub-frame period, the light blocking data is supplied as blue data to each pixel through the scanning operation. Further, the blue light emitting element is turned on when a predetermined time period has elapsed from the start time of the third sub-frame period, and is turned off at the end time thereof.

When such driving is performed, in an area above the dotted line illustrated in FIG. 2, red light is transmitted in the first sub-frame period. In the second and third sub-frame periods, light blocking data are respectively supplied as green data and blue data. Therefore, green light and blue light cannot be transmitted through the area. As a result, a red image with no color unevenness is displayed in the area. The area, in which such a red image with no color unevenness is displayed, is referred to as a display area.

In contrast, in an area under the dotted line illustrated in FIG. 2, the red light is transmitted in the first sub-frame period, and the green light is transmitted in the second sub-frame period. As a result, in a viewed image of the area, there is color unevenness where red and green are mixed. The area, in which such a red image with color unevenness is displayed, is referred to as a non-display area.

As described above, the timing of supplying the image data and the lighting start time of the light emitting element are adjusted, and the lighting time period of the light emitting element is further adjusted. Thereby, the display area capable of displaying an image with no color unevenness can be provided on the screen. In addition, in the present description, a period, in which the light emitting element of each color is turned on in each sub-frame period, may be set as a specific period.

Further, instead of the image with color unevenness displayed in the non-display area, a screen, which does not change for each sub-frame, may be used. Specifically, the screen may be a screen in a state where an amount of transmitted light with a background color is maximized, a screen in a state where the light with the background color is transmitted at an arbitrary transmittance, a screen in a state where the transmitted light is blocked such that the amount of transmitted light with the background color is minimized, or a screen on which a non-color image is displayed. Thereby, by suppressing the load on the driving circuit such that the load does not increase, it is possible to display only a screen on which there is no color unevenness.

<1.3 Third Driving Method>

Figure 3:
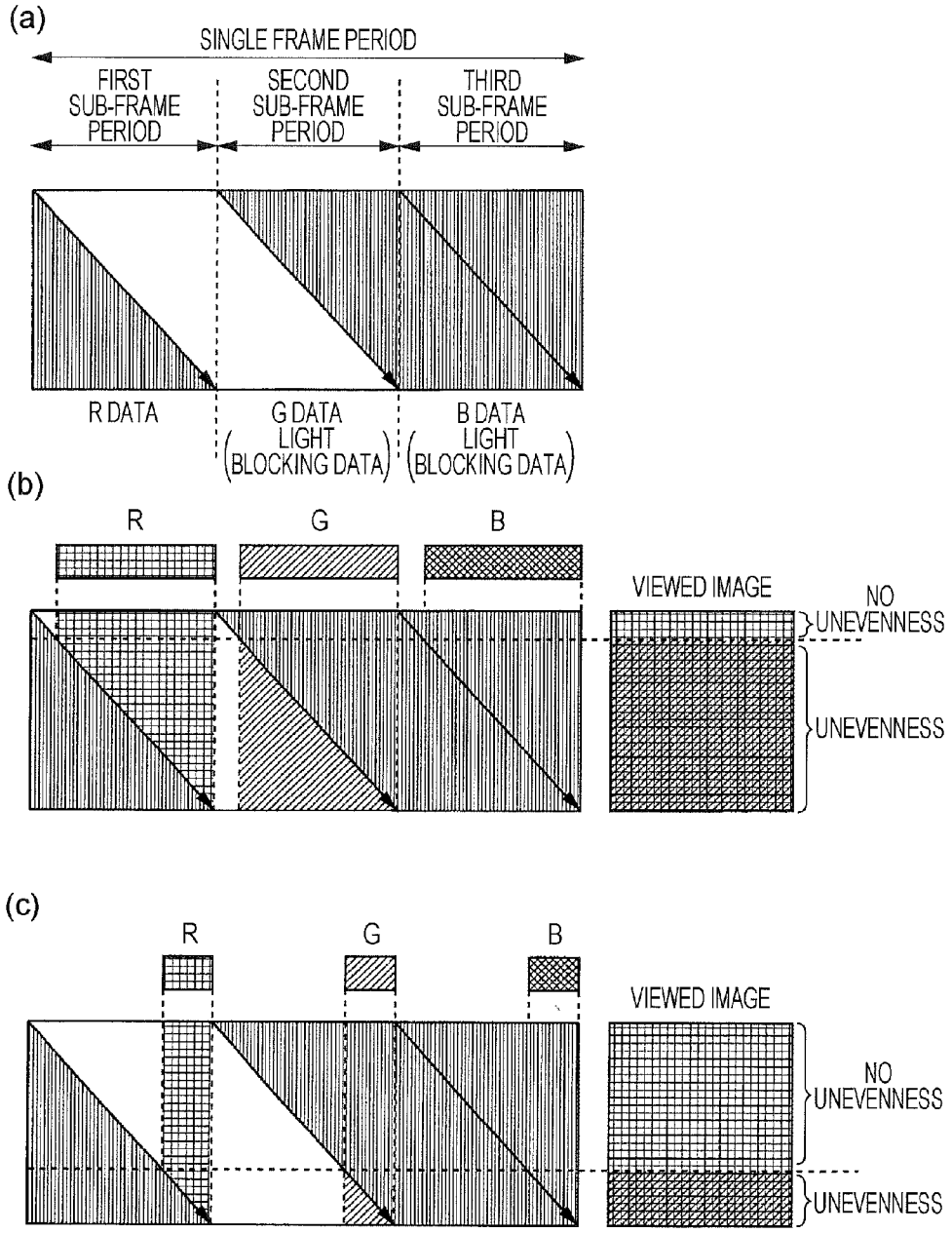
FIG. 3 is a diagram illustrating a method of adjusting an area of a display area capable of displaying an image with no color unevenness. More specifically, FIG. 3(*a*) is a diagram illustrating timing of supplying data for red image display to the liquid crystal panel, FIG. 3(*b*) is a diagram illustrating a method of decreasing the area of the display area capable of displaying the image with no color unevenness, and FIG. 3(*c*) is a diagram illustrating a method of increasing the area of the display area capable of displaying the image with no color unevenness.

Study of a method of adjusting an area of the display area capable of displaying an image with no color unevenness in the second driving method will be described. FIG. 3 is a diagram illustrating a method of adjusting an area of a display area capable of displaying an image with no color unevenness. More specifically, FIG. 3(*a*) is a diagram illustrating timing of supplying data for red image display to the liquid crystal panel, FIG. 3(*b*) is a diagram illustrating a method of decreasing the area of the display area capable of displaying the image with no color unevenness, and FIG. 3(*c*) is a diagram illustrating a method of increasing the area of the display area capable of displaying the image with no color unevenness.

As illustrated in FIG. 3(*a*), the scanning operation for supplying the data for red image display is the same as that in the case of FIG. 2(*a*), and thus the description thereof will be omitted.

As illustrated in FIG. 3(*b*), the closer each of the lighting start times of the red, green, and blue light emitting elements in each sub-frame period is to the start time of the scanning operation, that is, the start time of each sub-frame period, the smaller the area of the display area capable of displaying the red image with no color unevenness. However, the lighting time period of the red light emitting element becomes longer, and thus the luminance of the red image becomes higher.

In contrast, as illustrated in FIG. 3(*c*), the farther each of the lighting start times of the red, green, and blue light emitting elements in each sub-frame period is from the start time of the scanning operation, that is, the start time of each sub-frame period, the larger the area of the display area capable of displaying the red image with no color unevenness. However, the lighting time period of the red light emitting element becomes shorter, and thus the luminance of the red image becomes lower.

In such a manner, when the start time of the scanning operation is set to be constant, by adjusting the lighting start time and the lighting time period of each light emitting element, it is possible to increase or decrease the area of the display area capable of displaying an image with no color unevenness.

<1.4 Fourth Driving Method>

Figure 4:
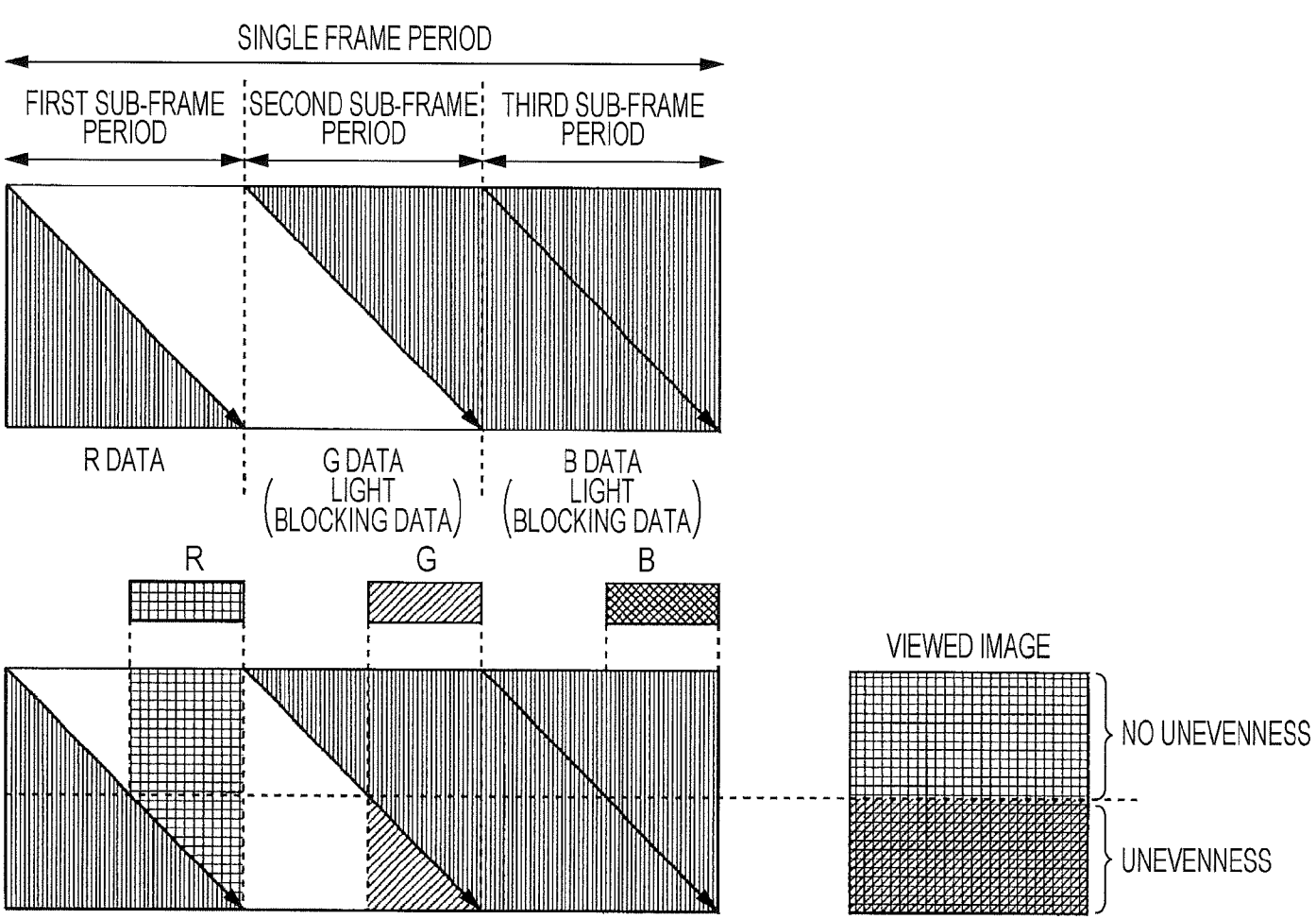
FIG. 4 is a diagram illustrating a method of setting the display area, which is capable of displaying an image with no color unevenness, as the upper half of a screen. More specifically, FIG. 4(*a*) is a diagram illustrating timing of supplying data for red image display to the liquid crystal panel, and FIG. 4(*b*) is a diagram illustrating lighting start times and lighting time periods of light emitting elements of respective colors.
Figure 5:
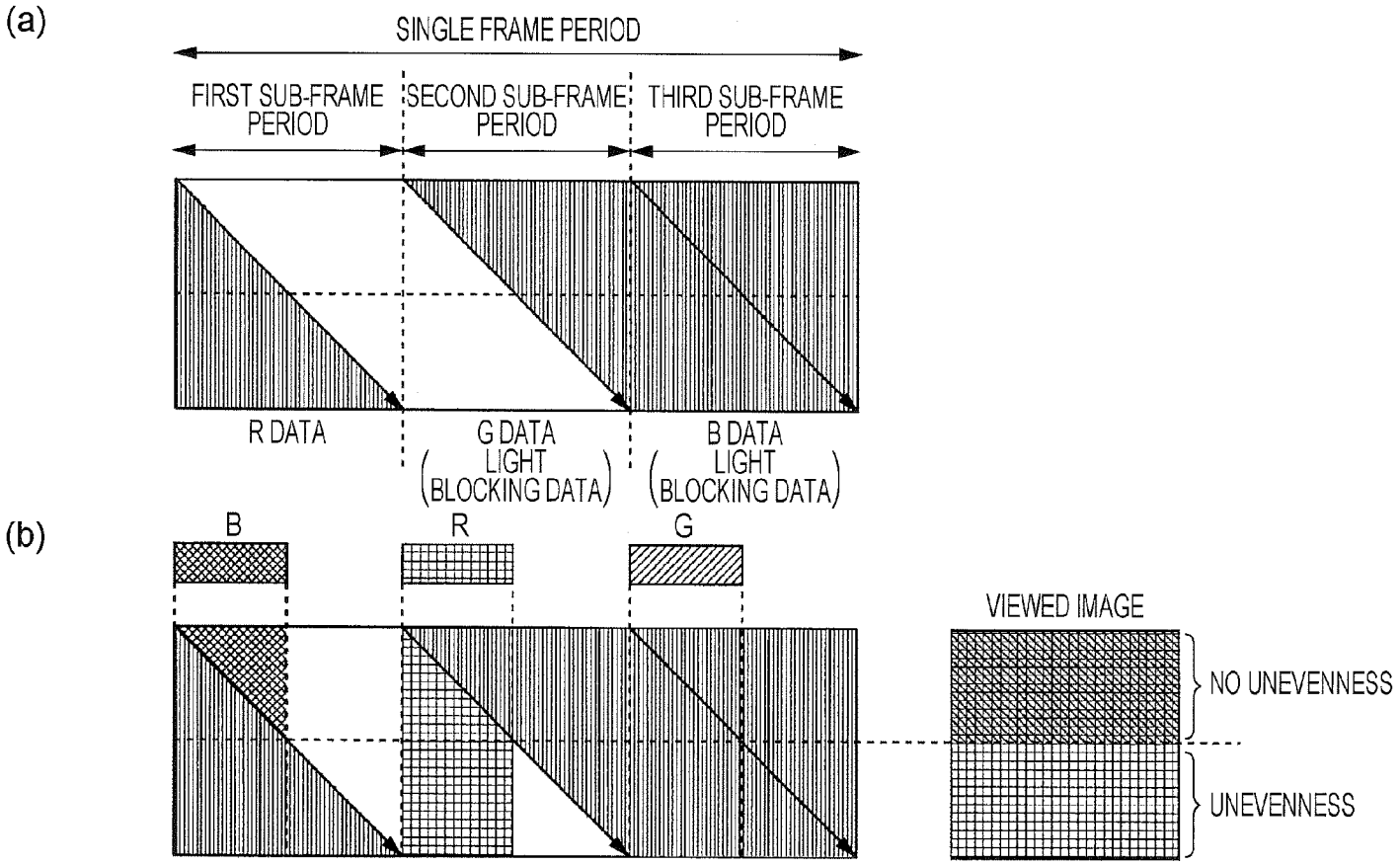
FIG. 5 is a diagram illustrating a method of setting the display area, which is capable of displaying an image with no color unevenness, as the lower half of a screen. More specifically, FIG. 5(*a*) is a diagram illustrating timing of supplying data for red image display to the liquid crystal panel, and FIG. 5(*b*) is a diagram illustrating lighting start times and lighting time periods of light emitting elements of respective colors.

Study of a method of adjusting a position of the display area capable of displaying an image with no color unevenness in the second driving method will be described. FIG. 4 is a diagram illustrating a method of setting the display area, which is capable of displaying the image with no color unevenness, as the upper half of a screen. More specifically, FIG. 4(*a*) is a diagram illustrating timing of supplying data for red image display to the liquid crystal panel, and FIG. 4(*b*) is a diagram illustrating lighting start times and lighting time periods of light emitting elements of respective colors. Further, FIG. 5 is a diagram illustrating a method of setting the display area, which is capable of displaying the image with no color unevenness, as the lower half of a screen. More specifically, FIG. 5(*a*) is a diagram illustrating timing of supplying data for red image display to the liquid crystal panel, and FIG. 5(*b*) is a diagram illustrating lighting start times and lighting time periods of light emitting elements of respective colors.

As illustrated in FIG. 4(*a*), in a case of setting a display area, which is capable of displaying the image with no color unevenness, as the upper half of the screen, the scanning operation for supplying the red data is the same as that in the case of FIG. 2(*a*), and the description thereof will be omitted.

Further, as illustrated in FIG. 4(*b*), the red light emitting element is turned on from when ½ of the period of the first sub-frame period has elapsed to the end time thereof. Thereby, in the period in which the red light emitting element is turned on, red light is transmitted through the entire screen. Next, in the second sub-frame period, the green light emitting element is turned on from when ½ of the period thereof has elapsed to the end time thereof. Thereby, in the period in which the green light emitting element is turned on, green light is transmitted through the lower half of the screen. Next, in the third sub-frame period, the blue light emitting element is turned on from when ½ of the period thereof has elapsed to the end time thereof. However, in the third sub-frame period, light blocking data is supplied to all pixels. Therefore, blue light is blocked on the basis of the light blocking data, and light blocking is performed such that the amount of transmitted light is minimized.

Thereby, for each single frame period, a red image with no color unevenness is displayed on the upper half of the screen, and an image with color unevenness, in which green is mixed with red, is displayed on the lower half of the screen.

Next, a description will be given of a case where the display area capable of displaying an image with no color unevenness is set as the lower half of the screen. As illustrated in FIG. 5(*a*), in each sub-frame period, the scanning operation is started from the start time of each sub-frame period. Further, as illustrated in FIG. 5(*b*), the red light emitting element is turned on from the start time of the second sub-frame period to when ½ of the period thereof has elapsed. Thereby, in the second sub-frame period, red light is transmitted through the entire screen. The green light emitting element is turned on from the start time of the third sub-frame period to when ½ of the period thereof has elapsed. However, in the third sub-frame period, light blocking data is supplied as green data. Therefore, green light is blocked on the basis of the light blocking data, and light blocking is performed such that the amount of transmitted light is minimized. The blue light emitting element is turned on from the start time of the first sub-frame period of the subsequent frame to when ½ of the period thereof has elapsed. Thereby, in the first sub-frame period, blue light is transmitted through the upper half of the screen. Hence, an image, in which blue is mixed with red, is displayed as a viewed image on the upper half of the screen, and a red image with no color unevenness is displayed on the lower half of the screen.

In FIGS. 5(*a*) and 5(*b*), in a similar manner to the case of FIGS. 4(*a*) and 4(*b*), the scanning operation is started at the start time of each sub-frame period, and the lighting start time of each light emitting element is delayed by ½ of the period. However, the lighting time of each light emitting element is set to be the same as that of FIGS. 4(*a*) and 4(*b*), whereby the scanning operation may be started earlier by ½ of the period than that. As described above, by adjusting the timing between the start time of the scanning operation and the lighting start time of the light emitting element, the display area capable of displaying an image with no color unevenness can be provided at an arbitrary position on the screen.

<1.5 Fifth Driving Method>

Figure 6:
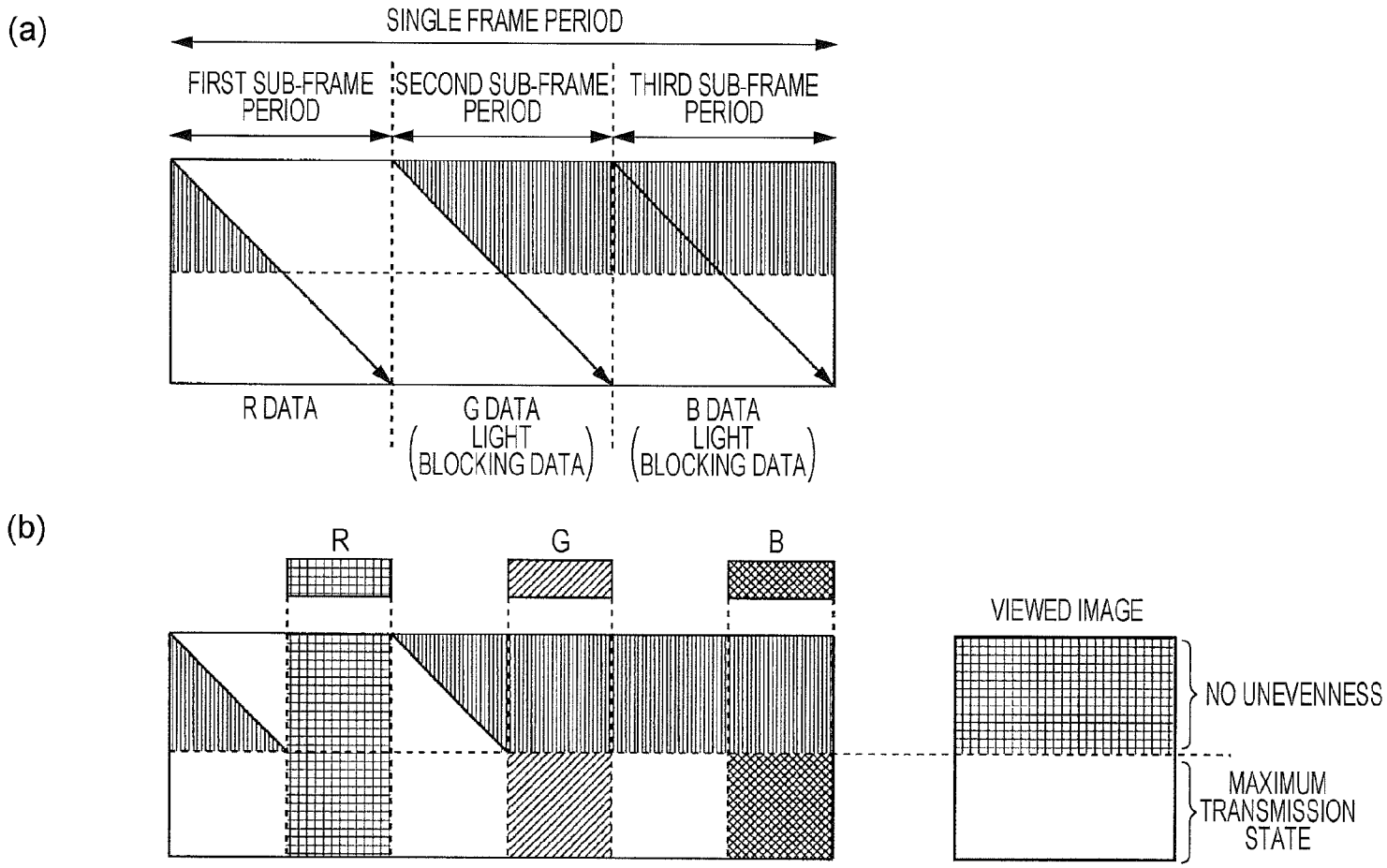
FIG. 6 is a diagram illustrating a method of setting the display area, which is capable of displaying an image with no color unevenness, as the upper portion of a screen and setting the lower half of the screen as a non-display area which is in a maximum transmission state. More specifically, FIG. 6(*a*) is a diagram illustrating timing of supplying data for red image display to the liquid crystal panel, and FIG. 6(*b*) is a diagram illustrating lighting start times and lighting time periods of light emitting elements of respective colors.

A description will be given of study of a method of displaying a red image with no color unevenness on the upper half of the screen and setting the lower half of the screen, in which color unevenness occurs, as the non-display area which is in the maximum transmission state in a similar manner to the fourth driving method. FIG. 6 is a diagram illustrating a method of setting the display area, which is capable of displaying an image with no color unevenness, as the upper portion of a screen and setting the lower half of the screen as a non-display area which is in a maximum transmission state. More specifically, FIG. 6(*a*) is a diagram illustrating timing of supplying data for red image display to the liquid crystal panel, and FIG. 6(*b*) is a diagram illustrating lighting start times and lighting time periods of light emitting elements of respective colors.

First, as illustrated in FIG. 6(*a*), in the first sub-frame period, in a similar manner to the case of FIG. 2(*a*), the scanning operation is performed from the start time to the end time. In the scanning operation, the transmission data is supplied as red data to the pixels on the upper half of the screen. Further, the transmission data, which is for maximizing the amount of transmitted red light originating from the light emitting element, is supplied as red data to the pixels on the lower half of the screen. Next, in the second sub-frame period, the scanning operation is performed from the start time to the end time. In the scanning operation, the light blocking data is supplied as green data to the pixels on the upper half of the screen, and the transmission data, which is for maximizing the amount of transmitted green light originating from the light emitting element, is supplied as green data, which is the same as the red data, to the pixels on the lower half of the screen. Also in the third sub-frame period, in a similar manner to a second sub-frame period, through the scanning operation, the light blocking data is supplied as blue data to the pixels on the upper half of the screen, and the transmission data, which is for maximizing the amount of transmitted light originating from the light emitting element, is supplied as blue data, which is the same as red data, to the pixels on the lower half of the screen.

Next, as illustrated in FIG. 6(*b*), in the first sub-frame period, the red light emitting element is turned on from when ½ of the period has elapsed from the start time thereof until the end time thereof. Likewise, also in the second and third sub-frame periods, each of the green and blue light emitting elements is turned on from when ½ of the period has elapsed from each start time thereof until the end time thereof.

Thereby, in the first sub-frame period, from when ½ of the period has elapsed from the start time thereof until the end time thereof, red light is transmitted through the upper half and the lower half of the screen at the maximum transmittance of the liquid crystal panel. In the second sub-frame period, from when ½ of the period has elapsed from the start time thereof until the end time thereof, in the upper half of the screen, light blocking is performed such that the amount of transmitted green light is minimized on the basis of the light blocking data, and in the lower half of the screen, green light is transmitted at the maximum transmittance of the liquid crystal panel. Likewise, also in the third sub-frame period, in the upper half of the screen, light blocking is performed such that the amount of transmitted blue light is minimized, and in the lower half of the screen, blue light is transmitted at the maximum transmittance of the liquid crystal panel.

As a result, only red light corresponding to the red data is transmitted through the upper half of the screen, and red light, green light, and blue light are transmitted through the lower half of the screen. The light amounts of the red light, green light, and blue light are determined in accordance with the transmission data supplied as the red data or the green data and blue data the same as the red data. Hence, a red image is displayed as a viewed image on the upper half of the screen, and the lower half of the screen is set as the non-display area in a state where the amount of transmitted light with the background color is at the maximum.

As described above, in each sub-frame period, the transmission data, which are for maximizing the amounts of transmitted red light, green light, and blue light, are respectively supplied to areas corresponding to the sub-frames. Thereby, in each sub-frame, the area, to which the image data for transmitting the maximum amount of light is supplied, attains a state where the amount of transmitted light with the background color is at the maximum. In other words, when the image data for transmission in each sub-frame is the same, color display is not possible, but display with no color unevenness is possible. More specifically, a maximum light blocking state may be achieved by inputting the same light blocking data to each sub-frame, an arbitrary transmission state may be achieved by inputting the same arbitrary transmittance data to each sub-frame, or an arbitrary non-color image may be displayed.

<1.6 Sixth Driving Method>

Figure 7:
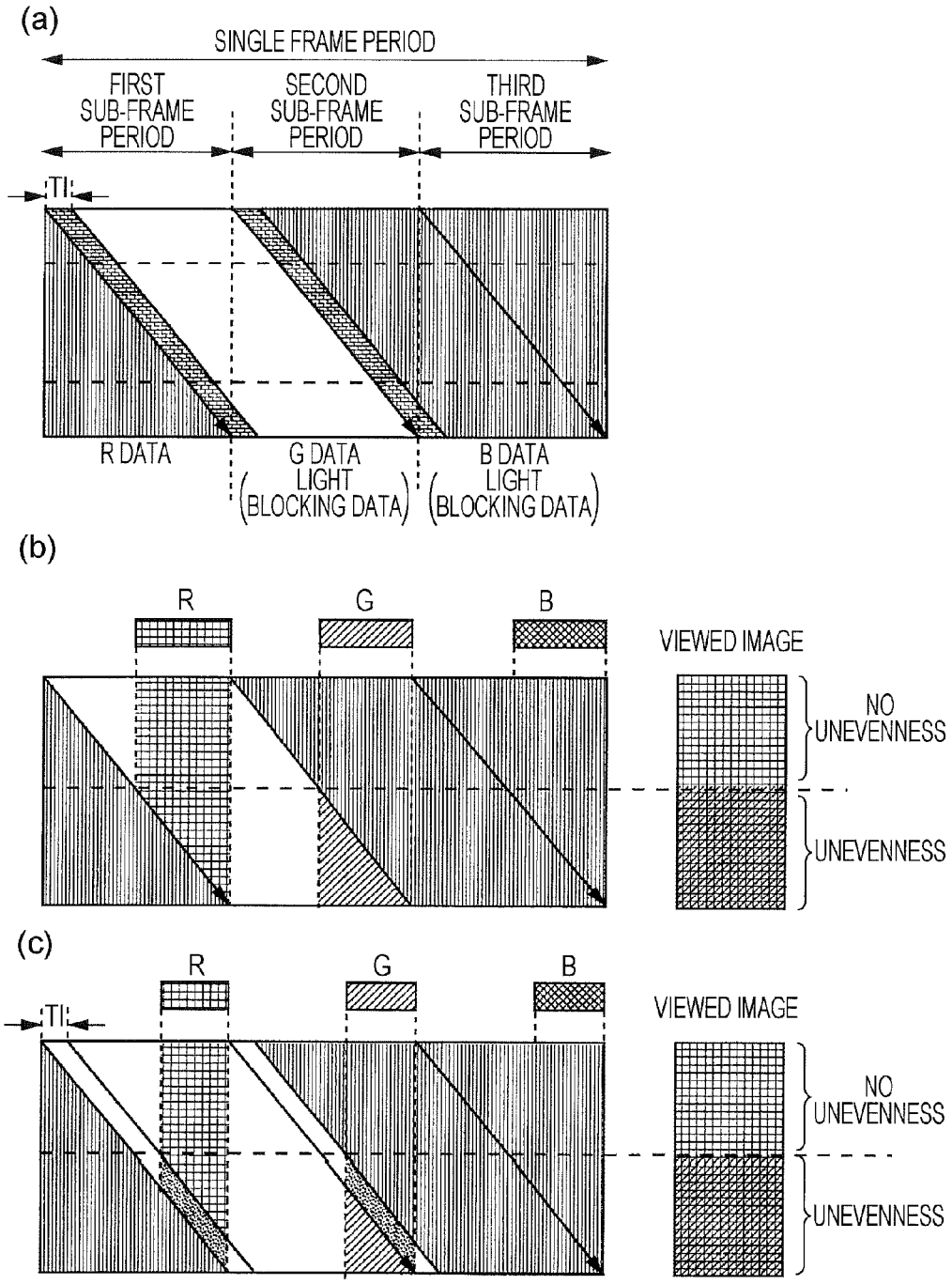
FIG. 7 is a diagram illustrating an effect of a response time period of the liquid crystal in a case of displaying a red image on the screen. More specifically, FIG. 7(*a*) is a diagram illustrating timing of supplying data for red image display to the liquid crystal panel, FIG. 7(*b*) is a diagram illustrating lighting start times and lighting time periods of light emitting elements of respective colors in a case where the response time period of the liquid crystal is not considered, and FIG. 7(*c*) is a diagram illustrating lighting start times and lighting time periods of light emitting elements of respective colors in a case where the response time period of the liquid crystal is considered.

In the first to fifth driving methods, it was assumed that, after the image data is supplied to the pixels, a time period (hereinafter referred to as a "liquid crystal response time period"), which elapses before the transmittance of the pixels reaches a predetermined value determined on the basis of the image data, is zero. However, practically, the liquid crystal response time period is not zero. Accordingly, a description will be given of a case where the liquid crystal response time period is considered. FIG. 7 is a diagram illustrating an effect of a response time period of the liquid crystal in a case of displaying a red image on the screen. More specifically, FIG. 7(*a*) is a diagram illustrating timing of supplying data for red image display to the liquid crystal panel, FIG. 7(*b*) is a diagram illustrating lighting start times and lighting time periods of light emitting elements of respective colors in a case where the response time period of the liquid crystal is not considered, and FIG. 7(*c*) is a diagram illustrating lighting start times and lighting time periods of light emitting elements of respective colors in a case where the response time period of the liquid crystal is considered.

As illustrated in FIG. 7(*a*), the scanning operation is performed from the start time of the first sub-frame period to the end time thereof, and the transmission data is supplied as red data to each pixel. Next, the scanning operation is performed from the start time of the second sub-frame period to the end time thereof, and the light blocking data is supplied as green data to each pixel. Also in the third sub-frame period, through the scanning operation which is the same as that in the case of the second sub-frame period, the light blocking data is supplied as blue data to each pixel.

In FIG. 7(*a*), a liquid crystal response time period Tl is expressed as a distance between the arrow, which indicates the scanning operation for supplying the red data, and the line which is in parallel with the arrow. The transmittance of the pixel, to which the transmission data is supplied as red data, reaches the predetermined value not when the image data is supplied but when the response time period Tl has further elapsed. Likewise, also in a case where the light blocking data as green data and blue data are supplied, the transmittance of the pixel reaches a minimum value when the response time period Tl has elapsed after the light blocking data is supplied. Consequently, a desired amount of red light is transmitted not when the red data is supplied but when the light blocking data is supplied as green data since when the liquid crystal response time period Tl has further elapsed.

Accordingly, in a similar manner to the case of the second driving method illustrated in FIG. 2, in a case where the liquid crystal response time period Tl illustrated in FIG. 7(*b*) is not considered, and in a case where the liquid crystal response time period Tl illustrated in FIG. 7(*c*) is considered, a red image with no color unevenness is displayed on the upper side of the screen. As can be seen from FIGS. 7(*b*) and 7(*c*), in order to make areas of the display areas, in which the red image with no color unevenness is displayed, the same, in the case where the liquid crystal response time period Tl is considered, compared with the case where the period is not considered, it is preferable to decrease the light source lighting time period of each light emitting element.

In addition, as described later, in the liquid crystal display device according to the present invention, in the case where the liquid crystal response time period Tl is considered, it is necessary for the input signal to include response time period designation data (Tl designation data), which indicates the liquid crystal response time period Tl, or it is necessary to provide a memory, which stores the Tl designation data, in the liquid crystal display device.

<1.7 Seventh Driving Method>

In the first to sixth driving methods, the case where the scanning operation performed in each sub-frame period is started at the start time of the sub-frame period and is ended at the end time is described. However, the scanning operation may be started at the start time of the sub-frame period and may be ended earlier than the end time of the sub-frame period.

Figure 8:
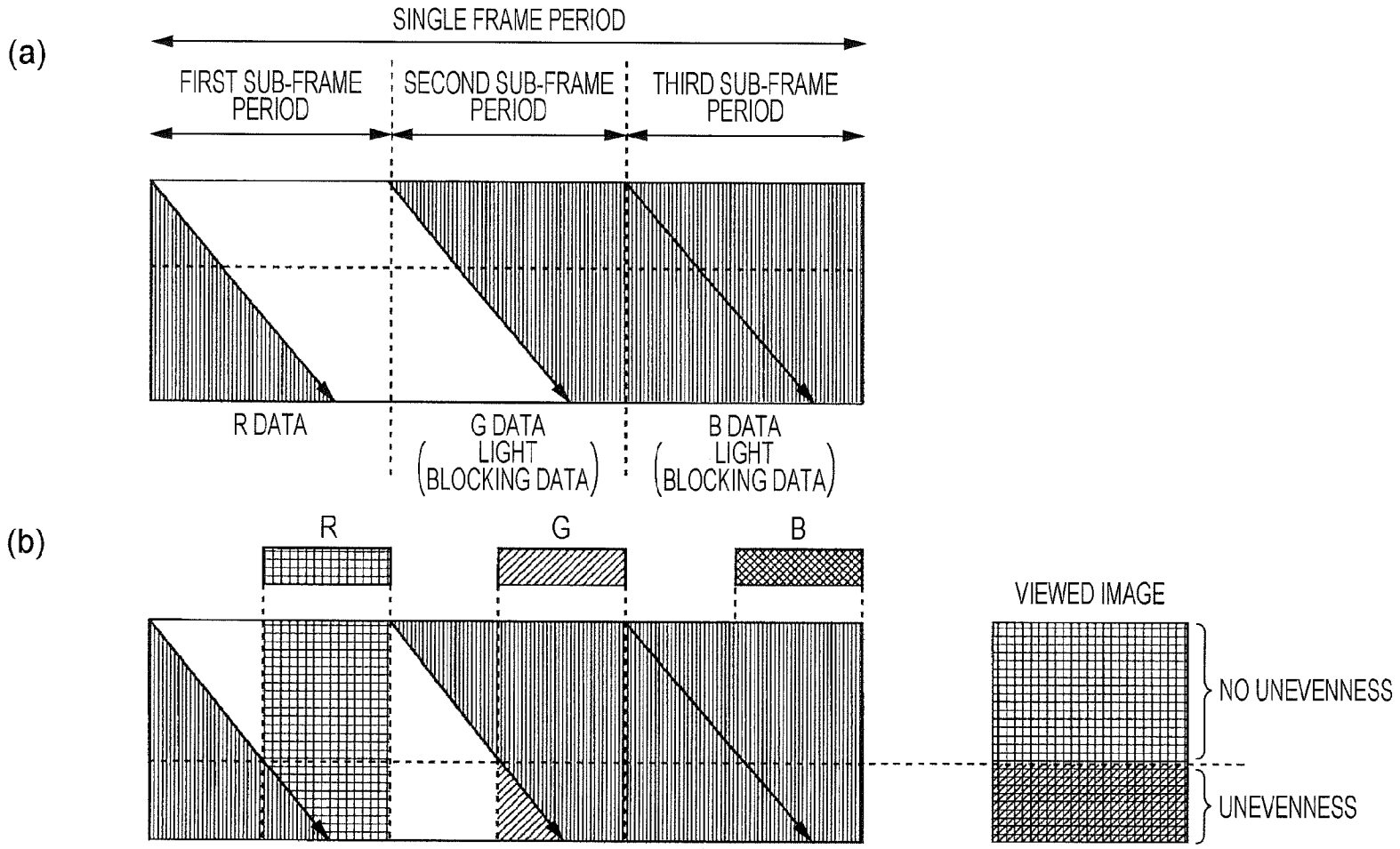
FIG. 8 is a diagram illustrating a case of ending a scanning operation at a time earlier than the end time of the sub-frame period. More specifically, FIG. 8(*a*) is a diagram illustrating timing of supplying data for red image display to the liquid crystal panel, and FIG. 8(*b*) is a diagram illustrating lighting start times and lighting time periods of light emitting elements of respective colors.

FIG. 8 is a diagram illustrating a case of ending a scanning operation at a time earlier than the end time of the sub-frame period. More specifically, FIG. 8(*a*) is a diagram illustrating timing of supplying data for red image display to the liquid crystal panel, and FIG. 8(*b*) is a diagram illustrating lighting start times and lighting time periods of light emitting elements of respective colors.

As illustrated in FIG. 8(*a*), the scanning operation is started from the start time of the first sub-frame period, and the scanning operation is ended before the end time. Through the scanning operation, the transmission data is supplied as red data to each pixel. Further, the red light emitting element is turned on when a predetermined time period has elapsed from the start time of the first sub-frame period, and is turned off at the end time thereof. Thereby, in a period from the end time of the scanning operation to the end time of the first sub-frame period, red light is transmitted through the entire screen.

Next, the scanning operation is started from the start time of the second sub-frame period, and the scanning operation is ended before the end time. Through the scanning operation, the light blocking data is supplied as green data to each pixel. Further, the green light emitting element is turned on when a predetermined time period has elapsed from the start time of the second sub-frame period, and is turned off at the end time thereof. Thereby, green light is transmitted through a part of the screen.

Likewise, in the third sub-frame period, the light blocking data is supplied as blue data to each pixel through the scanning operation. Further, the blue light emitting element is turned on when a predetermined time period has elapsed from the start time of the third sub-frame period, and is turned off at the end time thereof. Thereby, blue light cannot be transmitted through the screen.

As described above, also by making the end time of the scanning operation earlier than the end time of the sub-frame period, it is possible to provide the display area, in which the red image with no color unevenness is displayed, on the screen. According to such a driving method, it is possible to increase the display area in which the red image with no color unevenness can be displayed, or it is possible to increase the luminance of the red image.

In addition, in the above description, the scanning operation is started at the same time as the start time of the sub-frame period, and is ended earlier than the end time thereof. However, the scanning operation may be started later than the start time of the sub-frame period, and may be ended at the same time as the end time. Further, the scanning operation may be started later than the start time of the sub-frame period, and may be ended earlier than the end time.

Examples of the above-mentioned liquid crystal display device capable of displaying an image with no color unevenness include a liquid crystal display device configured by hardware and a liquid crystal display device configured to control operations through software. Accordingly, hereinafter, the respective liquid crystal display devices will be sequentially described.

2. First Embodiment

A liquid crystal display device according to the first embodiment of the present invention is a liquid crystal display device configured by hardware.

2.1 Configuration of Liquid Crystal Display Device

Figure 9:
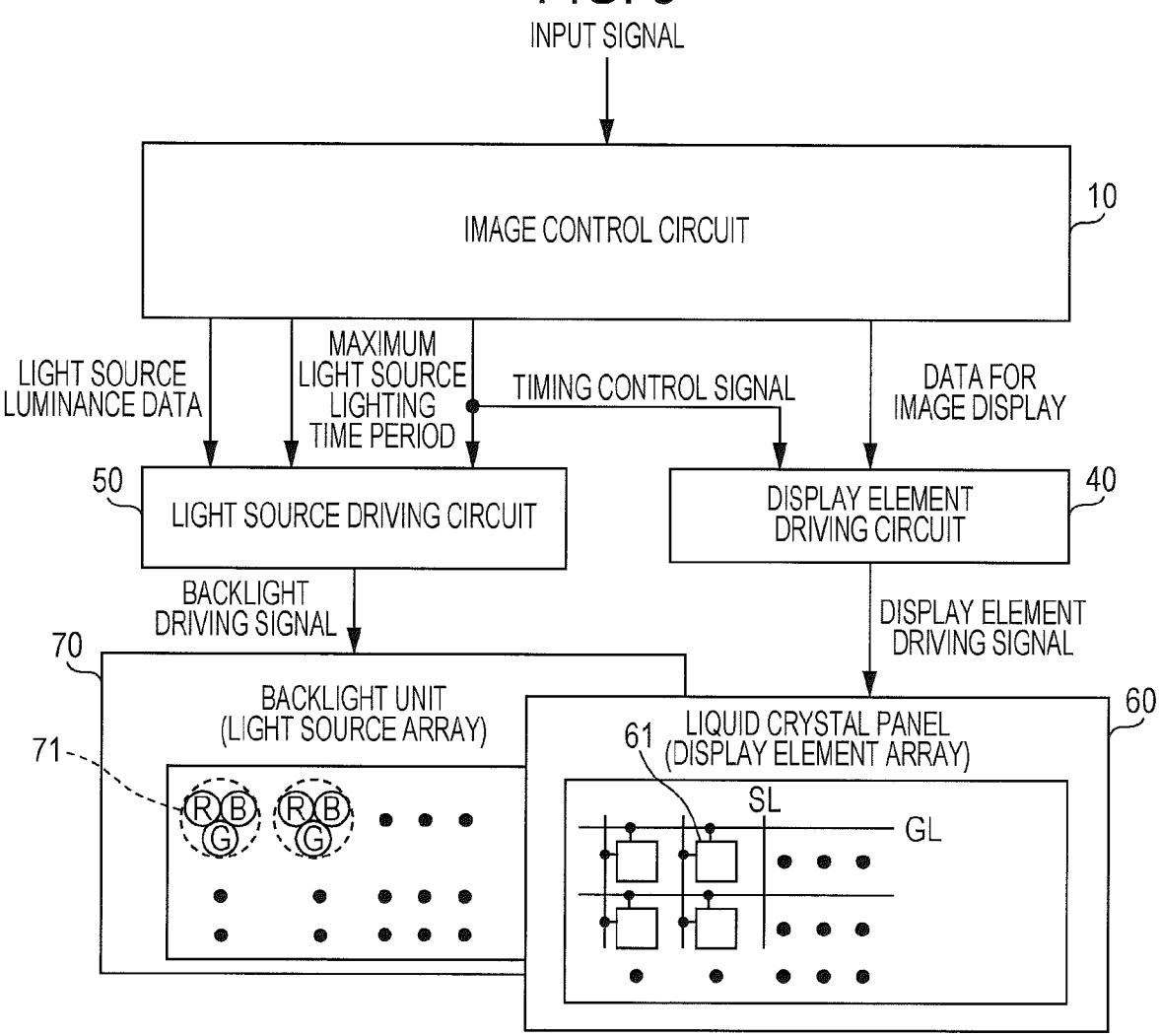
FIG. 9 is a block diagram illustrating a configuration of a liquid crystal display device according to a first embodiment of the present invention.

FIG. 9 is a block diagram illustrating a configuration of a liquid crystal display device according to the first embodiment of the present invention. As illustrated in FIG. 9, the liquid crystal display device includes an image control circuit 10, a display element driving circuit 40, a light source driving circuit 50, a liquid crystal panel 60, and a backlight unit 70. When an input signal including the image data is supplied from the outside to the image control circuit 10, the image control circuit 10 generates, on the basis of the input signal, the data for image display, a timing control signal for controlling the light source lighting start time, the light source lighting time period, and the light source luminance data. The data for image display is supplied to the display element driving circuit 40, the timing control signal is supplied to the display element driving circuit 40 and the light source driving circuit 50, and the light source lighting time period and the light source luminance data are supplied to the light source driving circuit 50.

In the liquid crystal panel 60, a plurality of display elements 61 are arranged in a matrix, and each display element 61 is connected to a scanning-line GL and a signal line SL. A display element driving signal, which is generated on the basis of the data for image display at a predetermined timing, is supplied to each display element 61. In addition, in the present description, for convenience of description, the data for image display may be defined to additionally include the display element driving signal.

The backlight unit 70 is disposed on the rear side of the liquid crystal panel 60. In the backlight unit 70, a plurality of light sources 71 each including one red light emitting element, one green light emitting element, and one blue light emitting element are arranged in a matrix. By sequentially turning on such red, green, and blue light emitting elements, the liquid crystal panel 60 is illuminated from the rear side thereof. Thereby, the liquid crystal panel 60 transmits light of which the amount is determined by the display element driving signal, whereby an image is displayed on the liquid crystal panel 60. The light emitting elements of the light sources 71 of the backlight unit 70 are formed of LEDs, CCFLs, or the like. In addition, the invention is not limited to the case where each of the light sources 71 includes one red light emitting element, one green light emitting element, and one blue light emitting element. For example, the light source may include two red light emitting elements, two green light emitting elements, and one blue light emitting element, or may include one red light emitting element, two green light emitting elements, and one blue light emitting element. Further, the invention is not limited to the case where the plurality of light sources 71 is arranged in a matrix inside the backlight unit 70, and the light sources may be arranged in a different manner. Further, the number of the light sources 71 is not limited to being plural, and may be one. For example, it may be possible to employ a single light source including one red light emitting element, one green light emitting element, and one blue light emitting element. Alternatively, it may be possible to employ a light source configured such that a color of light emitted by one white LED is switched using color filters or fluorescent substances emitting red light, green light, and blue light.

In each embodiment of the present invention, the light, which is emitted to the liquid crystal panel 60, is not limited to the backlight unit 70 which is disposed on the rear side of the liquid crystal panel. 60, and may be light which is emitted from the rear side of the liquid crystal panel 60. Specifically, examples of a configuration of a casing, of which the inner surface is white, include: a configuration in which an LED is disposed on the top of the casing so as to thereby emit light from the rear surface of the liquid crystal, panel 60; a configuration in which an LED disposed at an arbitrary position emits light from the rear surface of the liquid crystal panel 60 through a diffuser plate, a film, or a lens; and a configuration in which an LED is disposed on the side surface of the liquid crystal panel 60 so as to thereby emit light from the rear surface of the liquid crystal panel 60 by using a light guide plate. Accordingly, the illumination unit may be defined to include not only the backlight unit 70 but also such configurations.

Figure 10:
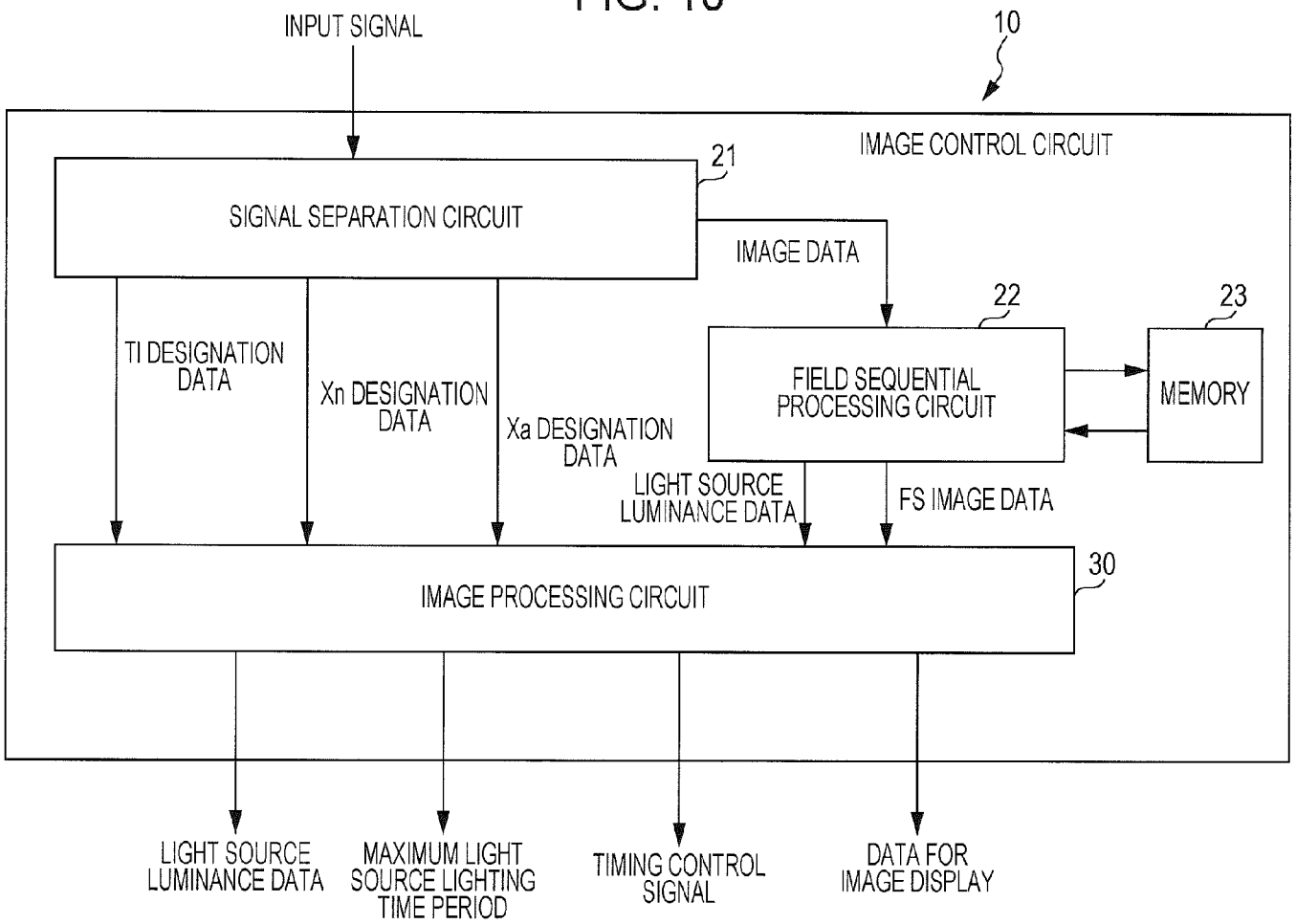
FIG. 10 is a block diagram illustrating a configuration of an image control circuit included in the liquid crystal display device illustrated in FIG. 9.

Next, a process in the image control circuit 10 will be described. FIG. 10 is a block diagram illustrating a configuration of the image control circuit 10. As illustrated in FIG. 10, the image control, circuit 10 includes a signal separation circuit 21, a field sequential processing circuit 22, a memory 23, and an image processing circuit 30.

The input signal, which is supplied from the outside to the image control circuit 10, is supplied to the signal separation circuit 21. The input signal includes: image data; display start line designation data (Xa designation data); non-display start line designation data (Xn designation data); and the Tl designation data. The display start line designation data is for designating a start position on the screen in the display area, in which an image with no color unevenness is displayed, by adjusting the lighting time period of the light emitting element and the timing between the start time of the scanning operation of the display element 61 and the lighting start time of the light emitting element. The non-display start line designation data is for designating a start position on the screen in the non-display area, in which color is not displayed but an image with no color unevenness is displayed, by making the image data of each sub-frame the same. The signal separation circuit 21 separates the image data, the Xa designation data, the Xn designation data, and the Tl designation data which are included in the input signal. Then, the image data is supplied to the field sequential processing circuit 22, and the Xa designation data, the Xn designation data, and the Tl designation data are supplied to the image processing circuit 30.

In a case of displaying a moving image, for example, when image data in which the frame rate is 1/60 sec is supplied, the field sequential processing circuit 22 stores the image data in the memory 23 connected to the field sequential processing circuit 22. Then, in the next frame period, when the image data in which the frame rate is 1/60 sec is input, frame rate conversion for performing a motion compensation process between the image data, which is stored in the memory 23, and the image data, which is newly input, is performed. Thereby, the image data, in which the frame rate is 1/60 sec, is converted into the image data in which the frame rate is 1/240 sec. Further, on the basis of the image data in which the frame rate is 1/240 sec, red, green, and blue field sequential image data (FS image data), in which the frame rate is 1/240 sec, is generated. Further, the light source luminance data, which indicates the luminance of each light source 71, is generated. The field sequential processing circuit 22 supplies the FS image data and the light source luminance data to the image processing circuit 30. In addition, the frame rate is not limited to 1/240 sec. However, it is preferable that the frame rate be converted into a high frame rare if it is possible to deal with the response speed of the display element 61.

Figure 11:
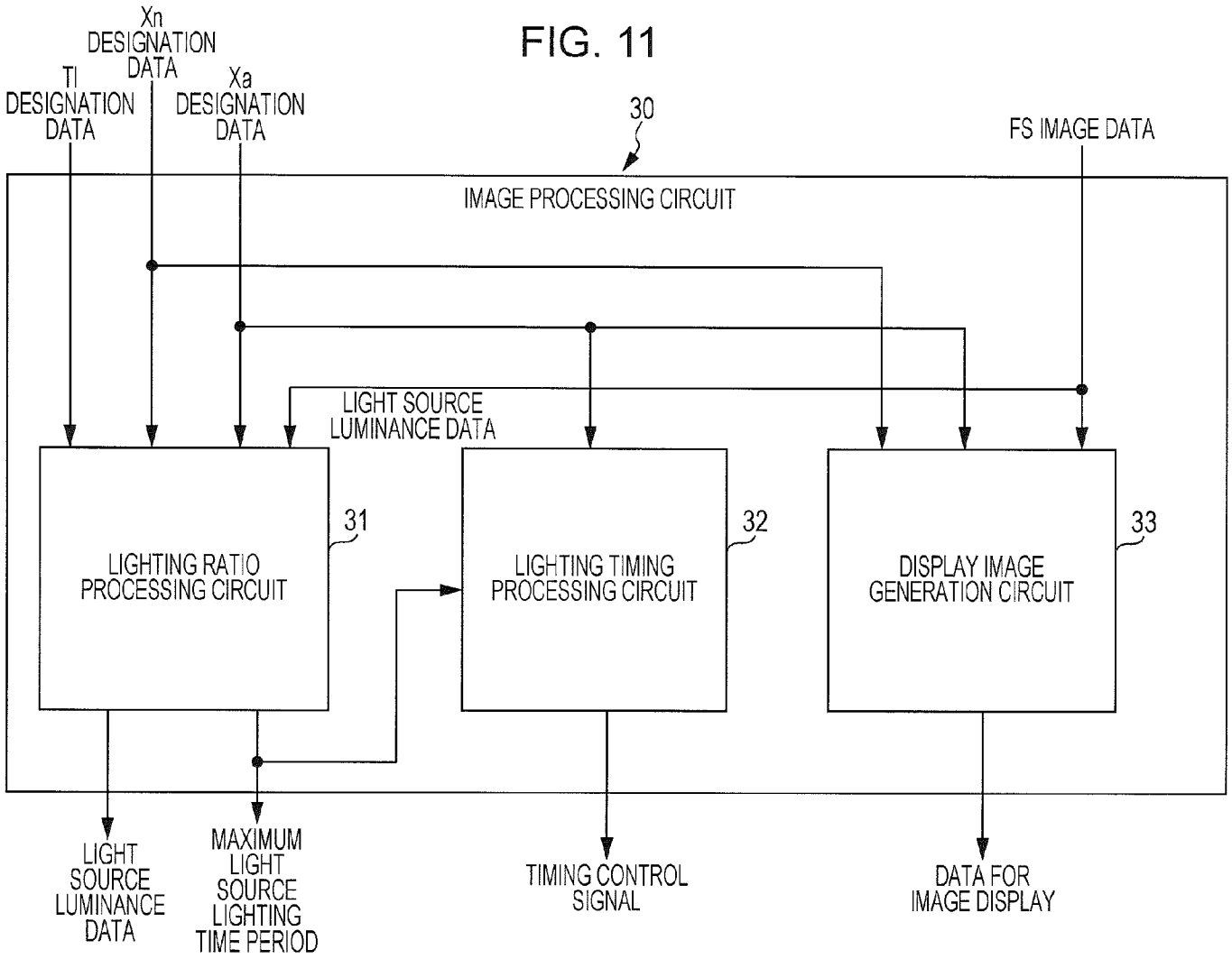
FIG. 11 is a block diagram illustrating a configuration of an image processing circuit included in the image control circuit illustrated in FIG. 10.

Next, a process in the image processing circuit 30 will be described. FIG. 11 is a block diagram illustrating a configuration of the image processing circuit 30. As illustrated in FIG. 11, the image processing circuit 30 includes a lighting ratio processing circuit 31, a lighting timing processing circuit 32, and a display image generation circuit 33. The lighting ratio processing circuit 31 is a circuit for acquiring a maximum light source lighting time period Tbm. The period is a maximum lighting time period among the lighting time periods of the light emitting elements included in the light sources 71. The lighting timing processing circuit 32 is a circuit for acquiring the timing control signal for controlling the light source lighting start time, on the basis of a time period (lighting driving adjustment time period Td) from the start time of the scanning operation of the display element 61 until the light emitting element is turned on. The lighting start time of the light emitting element is determined by the timing control signal.

The lighting ratio processing circuit 31 acquires the maximum light source lighting time period Tbm as a time period, in which the light emitting element is turned on, through any one of the following Expressions (1) to (3) by using the Tl designation data, the Xa designation data, and the Xn designation data which are supplied from the signal separation circuit 21.

It is determined which expression is used for calculation, on the basis of a magnitude relationship between the display start line Xa and the non-display start line Xn. Specifically, if the non-display start line Xn is larger than the display start line Xa, the following Expression (1) is used. If the display start line Xa is the same as the non-display start line Xn, the following Expression (2) is used. If the display start line Xa is larger than the non-display start line Xn, the following Expression (3) is used. It should be noted that, in the following Expressions (1) to (3), a single sub-frame period is represented by T, and the total number of lines of a display section is represented by X.

$$Tbm=T-Tl-\{T*(Xn-Xa)\}/X \quad (1)$$

$$Tbm=T \quad (2)$$

$$Tbm=T-Tl-\{T*(X+Xn-Xa)\}/X \quad (3)$$

The maximum light source lighting time period Tbm, which is acquired through the above Expressions (1) to (3), is a light source lighting time period for maximizing the luminance so as to attain a state where there is no color unevenness. It should be noted that, when the luminance may be sacrificed, a light source lighting time period Tb can be changed between 0 and the maximum light source lighting time period Tbm. In this case, the light source lighting start time and the light source lighting time period are arbitrarily set in a range of the maximum light source lighting time period Tbm.

The light source luminance data, which indicates the luminance of each light emitting element, is supplied from the field sequential processing circuit 22 to the lighting ratio processing circuit 31. Consequently, the lighting ratio processing circuit 31 outputs the maximum light source lighting time period Tbm, which is acquired through any one of Expressions (1) to (3), and the light source luminance data, which is output from the field sequential processing circuit 22, to the light source driving circuit 50, and supplies the maximum light source lighting time period Tbm also to the lighting timing processing circuit 32.

The lighting timing processing circuit 32 acquires the lighting driving adjustment time period Td through the following Expression (4) by using the Xa designation data, which is supplied from the signal separation circuit 21, and the maximum light source lighting time period Tbm which is supplied from the lighting ratio processing circuit 31.

The lighting driving adjustment time period Td is a time period for determining how late or early the light emitting element may be turned on with respect to the start time of the scanning operation of the display element 61.

$$Td=T-Tb+(T*Xa/X) \quad (4)$$

The lighting timing processing circuit 32 acquires the timing control signal based on the lighting driving adjustment time period Td which is acquired through Expression (4), and supplies the corresponding timing control signal to the display element driving circuit 40 and the light source driving circuit 50. In addition, instead of adjusting the lighting start time of the light emitting element, the start time of the scanning operation may be adjusted, or both the lighting start time and the start time of the scanning operation may be adjusted. Further, regarding the maximum light source lighting time period Tbm and the lighting driving adjustment time period Td represented by the above Expressions (1) to (4), it is assumed that the maximum luminance is displayed in a state where there is no color unevenness. However, if some color unevenness is allowed, the maximum light source lighting time period Tbm and the lighting driving adjustment time period Td may be increased or decreased by respective allowances thereof.

The display image generation circuit 33 generates the data for image display on the basis of the Xa designation data and Xn designation data, which is supplied from the signal separation circuit 21, and the FS image data which is supplied from the field sequential processing circuit 22. The data for image display includes image data for performing display in the display area and image data which is for displaying an image with no color unevenness in the non-display area without color display by making the image data of each sub-frame the same. Next, the display image generation circuit 33 outputs the data for image display to the display element driving circuit 40.

The light source driving circuit 50 acquires the light source lighting time period Tb by adjusting the maximum light source lighting time period Tbm in accordance with the luminance which is represented by the light source luminance data. Specifically, as a value of the light source luminance data decreases, the maximum light source lighting time period Tbm is decreased in accordance with the decrease, whereby the light source lighting time period Tb is acquired. As described above, the light source lighting time period Tb is adjusted in the range of the maximum light source lighting time period Tbm, which is a time period corresponding to the maximum value of the light source luminance data, on the basis of the light source luminance data. Next, the light source driving circuit 50 generates a backlight driving signal, which is for controlling operations of the backlight unit 70, on the basis of the light source lighting time period Tb, the timing control signal supplied from the lighting timing processing circuit 32, and the light source luminance data, and outputs the generated backlight driving signal to the backlight unit 70.

In the above description, the light source driving circuit 50 is a circuit different from the image control circuit 11, but may be a circuit included in the image control circuit 11. In this case, the image control circuit 11 outputs the light source lighting time period Tb which is acquired on the basis of the maximum light source lighting time period Tbm. It should be noted that the luminance of the light emitting element may be adjusted by changing a value of current, which is supplied to the light emitting element of the backlight unit 70, on the basis of the light source luminance data without changing the maximum light source lighting time period Tbm.

The backlight unit 70 turns the red, green, and blue light emitting elements included in the light sources 71 on or off, on the basis of the backlight driving signal.

Further, the display element driving circuit 40 generates the display element driving signals for driving the display elements 61, on the basis of the timing control signal supplied from the lighting timing processing circuit 32 and the data for image display supplied from the display image generation circuit 33, and outputs the signals to the liquid crystal panel 60. The liquid crystal panel 60 supplies the display element driving signals to the display elements 61 in the display area, in which an image with no color unevenness is displayed, in synchronization with lighting of the light emitting elements of the backlight unit 70, and supplies, for example, the display element driving signals, in which the image data of each sub-frame is the same and which is for displaying an image with no color unevenness without color display, to the display elements 61 of the non-display area in which color unevenness occurs. In addition, a detailed description will be given later of the data for image display which is generated by the display image generation circuit 33 and is supplied to the display element driving circuit 40.

In such a manner, the light emitting elements of the backlight unit 70 are turned on in synchronization with the timing of supplying the display element driving signals to the display elements 61 of the liquid crystal panel 60, whereby it is possible to provide a display area, in which an image with no color unevenness is displayed, at a desired position on the screen.

2.2 Image Processing Using Image Control Circuit

FIGS. 12 to 16 are diagrams respectively illustrating five cases in which the positions of the set display area and the set non-display area are different in accordance with a magnitude relationship between the display start line Xa and the non-display start line Xn and values thereof. Accordingly, referring to FIGS. 12 to 16, the five cases will be described sequentially. In addition, in the following description, it is assumed that a red image is displayed in the display area, and the non-display area is in a state where the amount of transmitted light with the background color is at the maximum. Further, in the description, it is assumed that the liquid crystal response time period Tl is zero. In addition, in the description of the viewed image of FIGS. 12 to 16, it is necessary to describe all lines of the liquid crystal panel 60 or all pixels arranged in the horizontal direction of the liquid crystal panel 60, for example, 1080 lines in a case of the liquid crystal panel having 1920 horizontal pixels×1080 vertical pixels. However, in the following description, it is assumed that the liquid crystal panel. 60 is formed of a total of eight lines from the 0th line at the top to the 7th line at the bottom. Further, the latticed area indicates a display area in which a red image is displayed. The area which is not latticed indicates a non-display area in a state where the amount of transmitted light with the background color is at the maximum.

Figure 12:
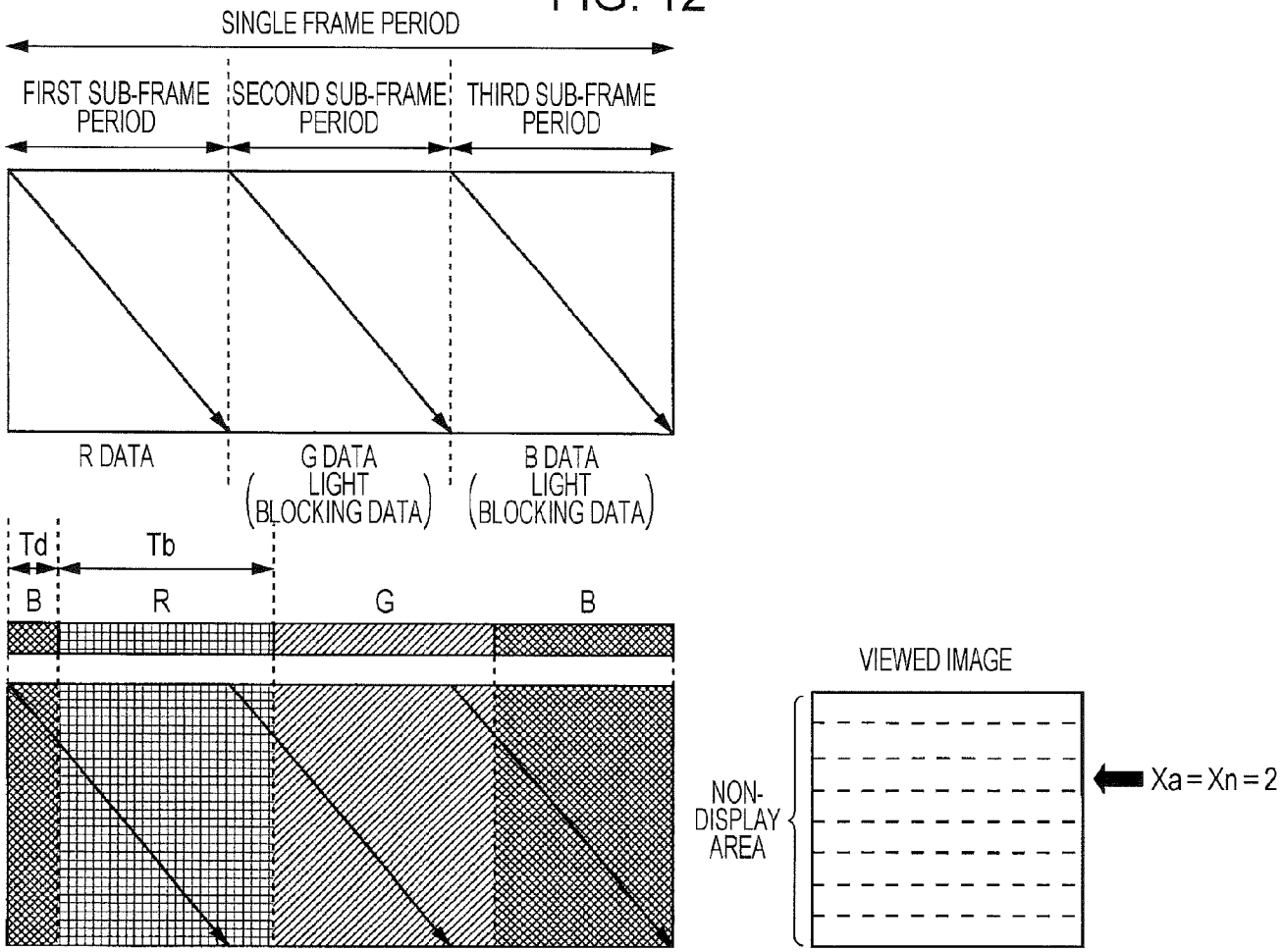
FIG. 12 is a diagram illustrating a case of setting the entire screen as the non-display area which is in the maximum transmission state, in the liquid crystal display device illustrated in FIG. 9.

FIG. 12 is a diagram illustrating a case of setting the entire screen as the non-display area in the state where the amount of transmitted light with the background color is at the maximum. As illustrated in FIG. 12, both the display start line Xa and the non-display start line Xn are positioned at the same line. Specifically, both the display start line Xa and the non-display start line Xn are set as a 2nd line. In this case, the entire screen is set as the non-display area in the state where the amount of transmitted light with the background color is at the maximum, and does not include the display area. Hence, the display image generation circuit 33 generates only the image data for performing display in the non-display area.

The scanning operation is started from the start time of each of the first to third sub-frame periods, and the image data (transmission data), which are for maximizing the amounts of transmitted red light, green light, and blue light, are sequentially supplied in the sub-frame periods. Further, in the first to third sub-frame periods, the red, green, and blue light emitting elements are respectively turned on at a time later by the lighting driving adjustment time period Td, which is acquired using Expression (4), than the start time of the scanning operation of the color image data corresponding to the colors of light of the light emitting elements. Then, the light emitting elements are turned off when the light source lighting time period Tb acquired on the basis of the maximum light source lighting time period Tbm of Expression (2) has elapsed. Thereby, light of each of the color light emitting elements is transmitted through the entire screen for the same time period. Therefore, the entire screen is set as the non-display area in the state where the amount of transmitted light with the background color is at the maximum, and there is no display area in which a red image is displayed.

Figure 13:
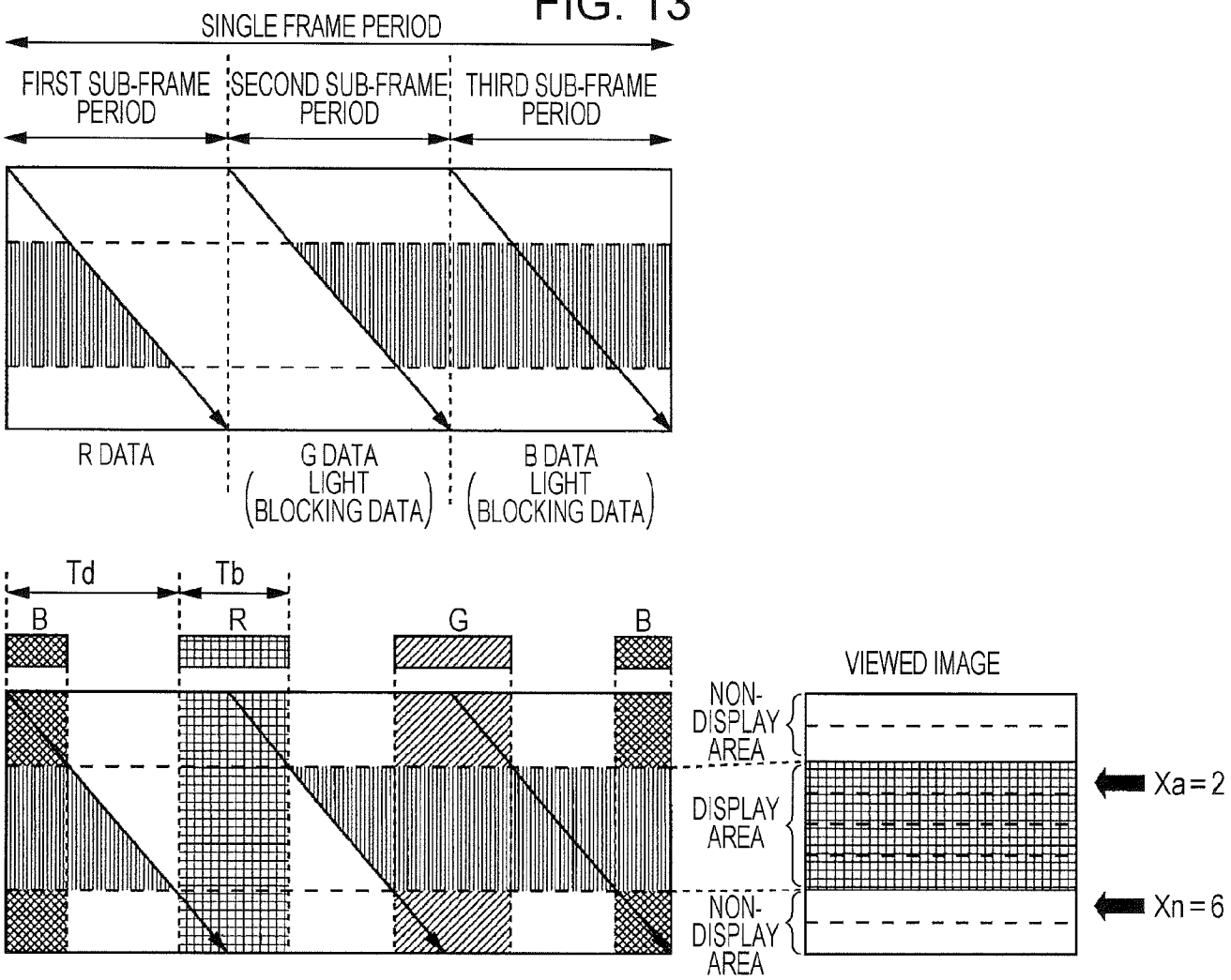
FIG. 13 is a diagram illustrating a case where the display area is provided in the middle of the screen and the non-display areas are provided such that the display area is interposed therebetween in the vertical direction, in the liquid crystal display device illustrated in FIG. 9.

FIG. 13 is a diagram illustrating a case where the display area is provided in the middle of the screen and the non-display areas are provided such that the display area is interposed therebetween in the vertical direction. As illustrated in FIG. 13, the display start line Xa is positioned at a line higher than the non-display start line Xn, and the display start line Xa is not zero. Specifically, the display start line Xa is the 2nd line, and the non-display start line Xn is the 6th line. In this case, the 2nd to 5th lines are set as a display area, and 0th and 1st lines and 6th and 7th lines are set as the non-display areas. Hence, the display image generation circuit 33 generates the image data for displaying the display area and the non-display areas.

The scanning operation is started from the start time of each of the first to third sub-frame periods. Through the scanning operation, in the first sub-frame period, the transmission data is supplied as red data to the 2nd to 5th lines, and the transmission data for transmitting red light is also supplied to the 0th and 1st lines and 6th and 7th lines. In the second sub-frame period, the light blocking data, which is for minimizing the amount of green light, is supplied as green data to the 2nd to 5th lines, and the transmission data for transmitting green light is supplied to the 0th and 1st lines and 6th and 7th lines. In third sub-frame period, in a similar manner to the case of the second sub-frame period, the transmission data as blue data and the light blocking data are supplied.

Meanwhile, in the first to third sub-frame periods, the red, green, and blue light emitting elements are respectively turned on at a time later by the lighting driving adjustment time period Td, which is acquired using Expression (4), than the start time of the scanning operation of the color image data corresponding to the colors of light of the light emitting elements. Then, the light emitting elements are turned off after the light source lighting time period Tb acquired on the basis of the maximum light source lighting time period Tbm of Expression (1) has elapsed. Thereby, the red light emitting element is turned on from the latter half of the first sub-frame period to the earlier half of the second sub-frame period, the green light emitting element is turned on from the latter half of the first sub-frame period to the earlier half of the second sub-frame period, and the blue light emitting element is turned on from the latter half of the third sub-frame period to the earlier half of the first sub-frame period of the next frame.

The red light is transmitted through the 2nd to 5th lines to which the transmission data is supplied as red data, and is transmitted through the 0th and 1st lines and 6th and 7th lines to which the transmission data for transmitting red light is supplied. However, the green light and blue light are blocked such that the amounts of transmitted light are minimized at the 2nd to 5th lines, and are transmitted through the 0th and 1st lines and 6th and 7th lines at the maximum transmittance.

As a result, at the 2nd to 5th lines, only the red light is transmitted, and thus an image corresponding to the red data is displayed. In contrast, at the 0th and 1st lines and 6th and 7th lines, light of each color is transmitted for the same time period, that is, by the same light amounts. Thereby, the 0th and 1st lines and 6th and 7th lines are set as the non-display areas in the state where the amount of transmitted light with the background color is at the maximum. In such a manner, the display area, in which a red image is displayed, is formed in the middle of the screen, and the non-display areas in the state where the amount of transmitted light with the background color is at the maximum are formed with the display area interposed therebetween in the vertical direction.

Figure 14:
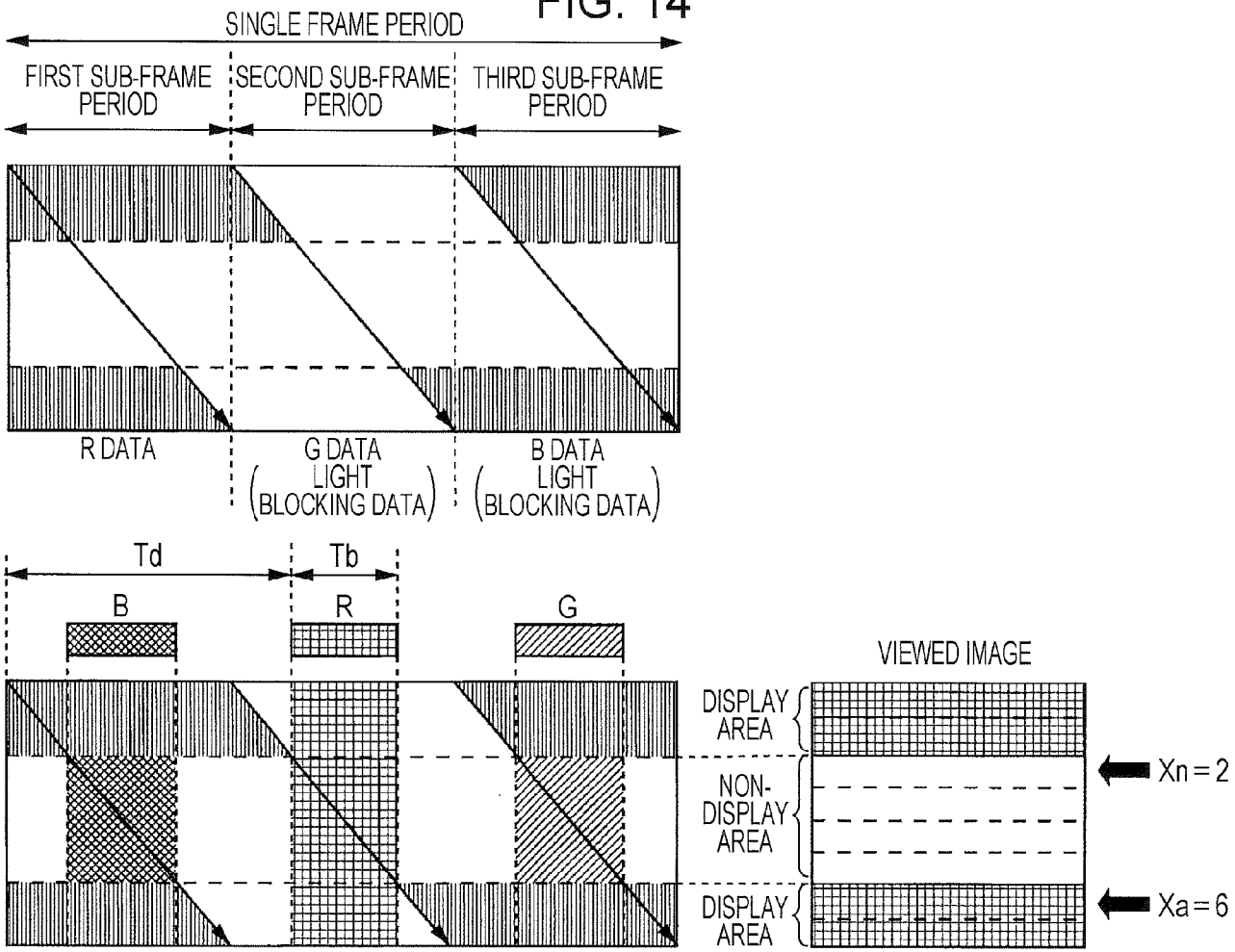
FIG. 14 is a diagram illustrating a case where the display areas are provided on the upper portion and the lower portion of the screen and the non-display area is provided in the middle of the screen between the display areas, in the liquid crystal display device illustrated in FIG. 9.

FIG. 14 is a diagram illustrating a case where the display areas are provided on the upper portion and the lower portion of the screen and the non-display area is provided in the middle of the screen between the display areas. As illustrated in FIG. 14, the display start line Xa is positioned at a line lower than the non-display start line Xn, and the display start line Xa is not zero. Specifically, the non-display start line Xn is the 2nd line, and the display start line Xa is the 6th line. In this case, the 2nd to 5th lines are set as a non-display area, and 0th and 1st lines and 6th and 7th lines are set as the display areas. Hence, the display image generation circuit 33 generates the image data for displaying the display areas and the non-display area. Further, the image data, which is displayed on the 0th and 1st lines, is generated with a delay of a single sub-frame period.

The scanning operation is started from the start time of each of the first to third sub-frame periods. Through the scanning operation, in the first sub-frame period, the transmission data is supplied as red data to the 6th and 7th lines, and the transmission data for transmitting red light is supplied to the 2nd to 5th lines. Further, the transmission data as red data, which is supplied to the 0th and 1st lines, is supplied to the second sub-frame period with a delay of a single sub-frame period. In the second sub-frame period, the light blocking data, which is for minimizing the amount of green light, is supplied as green data to the 6th and 7th lines, and the transmission data for transmitting green light is supplied to the 2nd to 5th lines. Further, the light blocking data, which is supplied to the 0th and 1st lines, is supplied as green data to the third sub-frame period with a delay of a single sub-frame period. In the third sub-frame period, the light blocking data, which is supplied as blue data, is supplied to the 6th and 7th lines, and the transmission data for transmitting blue light is supplied to the 2nd to 5th lines. Further, the light blocking data, which is supplied to the 0th and 1st lines, is supplied as blue data to the first sub-frame period of the next frame with a delay of a single sub-frame period.

Meanwhile, in the first to third sub-frame periods, the red, green, and blue light emitting elements are turned on at a time later by the lighting driving adjustment time period Td, which is acquired using Expression (4), than the start time of the scanning operation of the color image data corresponding to the colors of light of the light emitting elements. Then, the light emitting elements are respectively turned off after the light source lighting time period Tb acquired on the basis of the maximum light source lighting time period Tbm of Expression (3) has elapsed. Thereby, the red light emitting element is turned on at a time later by the lighting driving adjustment time period Td than the start time of the first sub-frame period. The green light emitting element is turned on at a time later by the lighting driving adjustment time period Td than the start time of the second sub-frame period. The blue light emitting element is turned on at a time later by the lighting driving adjustment time period Td than the start time of the third sub-frame period.

The red light is transmitted through the 0th and 1st lines and 6th and 7th lines to which the transmission data is supplied as red data, and is transmitted through the 2nd to 5th lines to which the transmission data is supplied. However, the green light and blue light are blocked such that amounts of transmitted light are minimized at the 0th and 1st lines and 6th and 7th lines, and are transmitted through only the 2nd to 5th lines to which the transmission data is supplied.

As a result, at the 0th and 1st lines and 6th and 7th lines, only the red light is transmitted. Thereby, a red image corresponding to the red data is displayed on the 0th and 1st lines and 6th and 7th lines. In contrast, at the 2nd to 5th lines, the light of each color is transmitted for the same time period, that is, by the same light amounts. Thereby, the 2nd to 5th lines are set as the non-display area in the state where the amount of transmitted light with the background color is at the maximum. In such a manner, the non-display area in the state where the amount of transmitted light with the background color is at the maximum is formed in the middle of the screen, and the display areas, in which a red image is displayed, are formed with the non-display area interposed therebetween.

Figure 15:
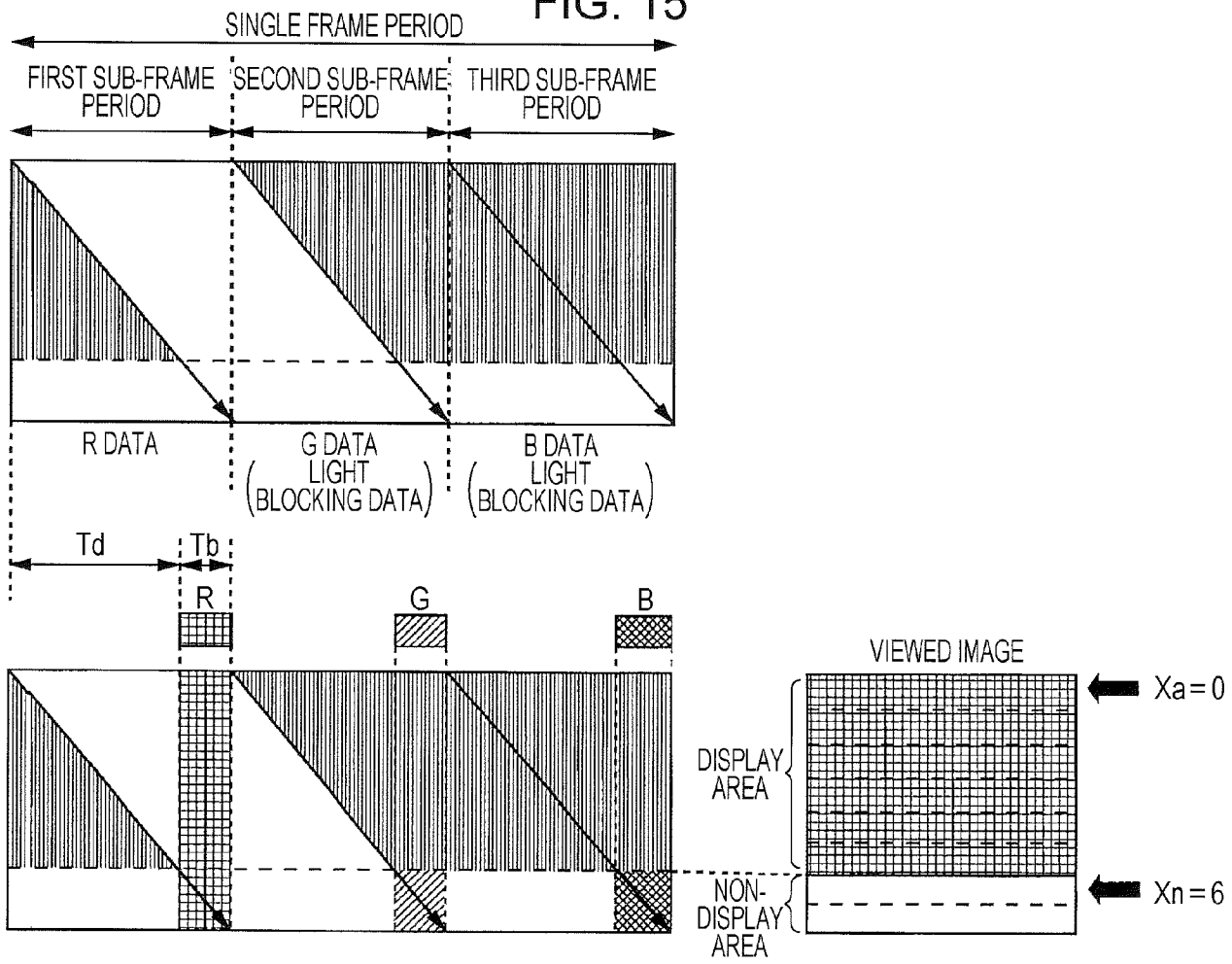
FIG. 15 is a diagram illustrating a case where the display area is provided on the upper portion of the screen and the non-display area is provided on the lower portion thereof, in the liquid crystal display device illustrated in FIG. 9.

FIG. 15 is a diagram illustrating a case where the display area is provided on the upper portion of the screen and the non-display area is provided on the lower portion thereof. As illustrated in FIG. 15, the non-display start line Xn is positioned at a line lower than the display start line Xa, and the display start line Xa is zero. Specifically, the non-display start line Xn is the 6th line, and the display start line Xa is the 0th line. In this case, the 0th to 5th lines are set as the display area, and the 6th and 7th lines are set as the non-display area. Hence, the display image generation circuit 33 generates the image data for displaying the display area and the non-display area.

The scanning operation is started from the start time of each of the first to third sub-frame periods, and the red data, green data, and blue data are respectively supplied to the sub-frame periods. At this time, the transmission data is supplied as red data to the 0th to 5th lines, and the transmission data for transmitting red light is supplied to the 6th and 7th lines. Further, the light blocking data, which is for minimizing the amount of green light, is supplied as green data to the 0th to 5th lines, and the transmission data for transmitting green light is supplied to the 6th and 7th lines. Likewise, the transmission data and the light blocking data are respectively supplied as blue data.

Meanwhile, in the first to third sub-frame periods, the red, green, and blue light emitting elements are turned on at a time later by the lighting driving adjustment time period Td, which is acquired using Expression (4), than the start time of the scanning operation of the color image data corresponding to the colors of light of the light emitting elements. Then, the light emitting elements are respectively turned off after the light source lighting time period Tb acquired on the basis of the maximum light source lighting time period Tbm of Expression (1) has elapsed. Thereby, the red light emitting element is turned on from the latter half of the first sub-frame period to the end time thereof, the green light emitting element is turned on from the latter half of the second sub-frame period to the end time thereof, and the blue light emitting element is turned on from the latter half of the third sub-frame period to the end time thereof.

The red light is transmitted through the 0th to 5th lines to which the transmission data is supplied as red data, and is transmitted through the 6th and 7th lines to which the transmission data for transmitting red light is supplied. However, the green light and blue light are blocked such that amounts of transmitted light are minimized at the 0th to 5th lines to which the light blocking data is supplied, and are transmitted through the 6th and 7th lines to which the transmission data is supplied.

As a result, at the 0th to 5th lines, only the red light is transmitted, and thus an image corresponding to the red data is displayed. In contrast, at the 6th and 7th lines, the light of each color is transmitted for the same time period, that is, by the same light amounts. Thereby, the 6th and 7th lines are set as the non-display area in the state where the amount of transmitted light with the background color is at the maximum. In such a manner, the display area, in which a red image is displayed, is formed on the upper side of the screen, and the non-display area in the state where the amount of transmitted light with the background color is at the maximum is formed on the lower side of the screen.

Figure 16:
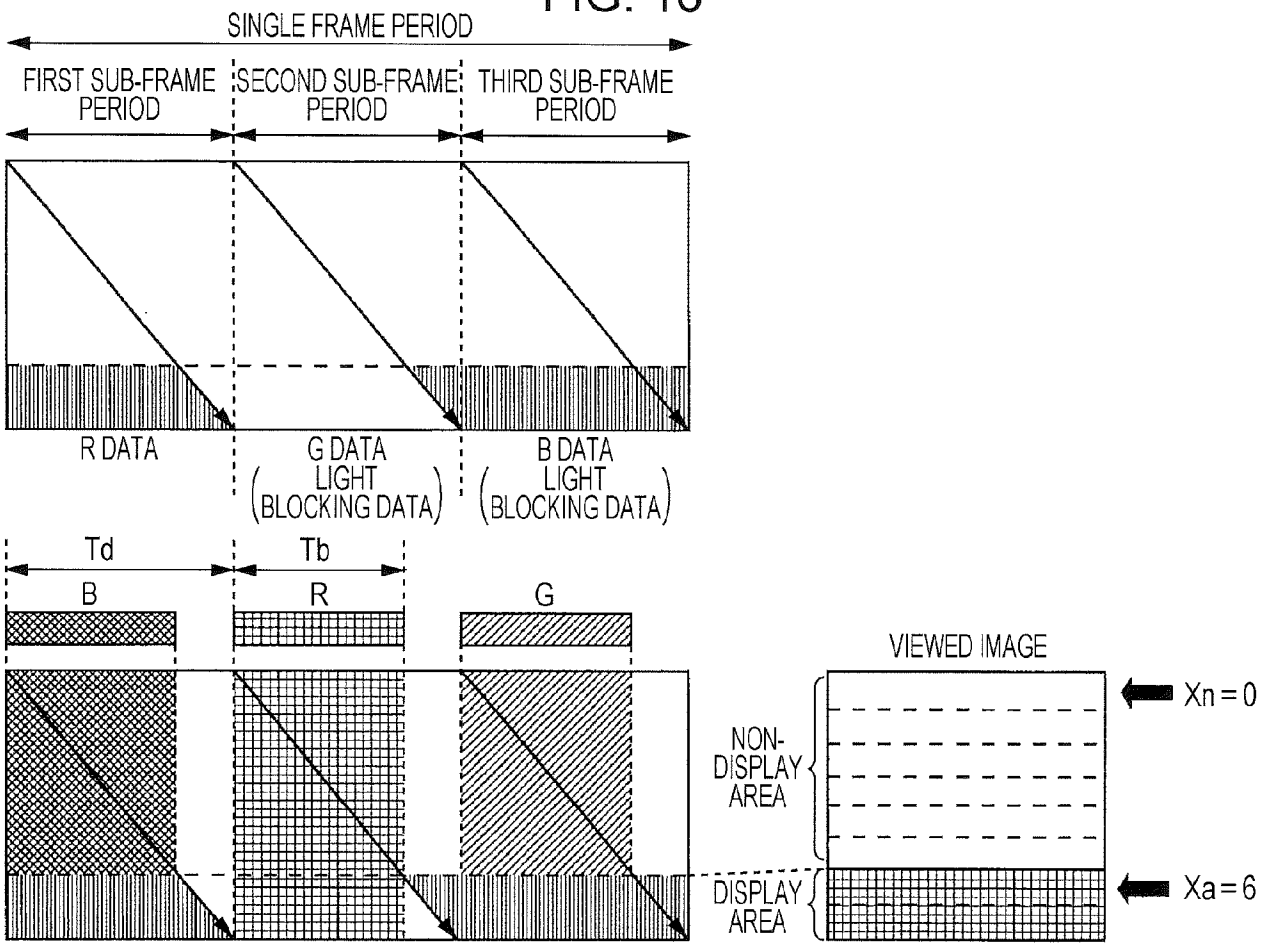
FIG. 16 is a diagram illustrating a case where the non-display area is provided on the upper portion of the screen and the display area is provided on the lower portion thereof, in the liquid crystal display device illustrated in FIG. 9.

FIG. 16 is a diagram illustrating a case where the non-display area is provided on the upper portion of the screen and the display area is provided on the lower portion thereof. As illustrated in FIG. 16, the display start line Xa is positioned at a line lower than the non-display start line Xn, and the non-display start line Xn is zero. Specifically, the non-display start line Xn is the 0th line, and the display start line Xa is the 6th line. In this case, the 0th to 5th lines are set as the non-display area, and the 6th and 7th lines are set as the display area. Hence, the display image generation circuit 33 generates the image data for displaying the display area and the non-display area.

The scanning operation is started from the start time of each of the first to third sub-frame periods, and the red data, green data, and blue data are respectively supplied to the sub-frame periods. At this time, the transmission data is supplied as red data to the 6th and 7th lines, and the transmission data for transmitting red light is supplied to the 0th to 5th lines. Further, the light blocking data, which is for minimizing the amount of green light, is supplied as green data to the 6th and 7th lines, and the transmission data for transmitting green light is supplied to the 0th to 5th lines. Likewise, the transmission data and the light blocking data are respectively supplied as blue data.

Meanwhile, in the first to third sub-frame periods, the red, green, and blue light emitting elements are respectively turned on at a time later by the lighting driving adjustment time period Td, which is acquired using Expression (4), than the start time of the scanning operation of the color image data corresponding to the colors of light of the light emitting elements. Then, the light emitting elements are turned off after the light source lighting time period Tb acquired on the basis of the maximum light source lighting time period Tbm of Expression (3) has elapsed. Thereby, the red light emitting element is turned on at the start time of the second sub-frame period, and is turned off before the end time thereof. The green light emitting element is turned on at the start time of the third sub-frame period, and is turned off before the end time thereof. The blue light emitting element is turned on at the start time of the first sub-frame period of the next frame, and is turned off before the end time thereof.

The red light is transmitted through the 6th and 7th lines to which the transmission data is supplied as red data, and is transmitted through the 0th to 5th lines to which the transmission data for transmitting red light is supplied. However, the light originating from the green light emitting element and the light originating from blue light emitting element are blocked such that amounts of transmitted light are minimized at the 6th and 7th lines to which the light blocking data is supplied, and are transmitted through the 0th to 5th lines to which the transmission data is supplied.

As a result, at the 6th and 7th lines, only the red light is transmitted, and thus an image corresponding to the red data is displayed. In contrast, at the 0th to 5th lines, light of each color light emitting element is transmitted for the same time period, that is, by the same light amount. Thereby, the 0th to 5th lines are set as the non-display area in the state where the amount of transmitted light with the background color is at the maximum. In such a manner, a red image is displayed, and is formed in the display area on the lower side of the screen, and the non-display area in the state where the amount of transmitted light with the background color is at the maximum is formed on the upper side of the screen.

2.3 Advantages

According to the embodiments, the liquid crystal panel 60 is sequentially illuminated with red light, green light, and blue light for each single frame period. Further, by performing the scanning operation in the first to third sub-frame periods, the red data is supplied to the display area in which a red image is displayed, and the light blocking data as green data and blue data are supplied to a different sub-frame area corresponding to the display area. Thereby, only red light is transmitted through the liquid crystal panel 60, and the green light and blue light are blocked such that the amount of transmitted light is minimized. Hence, the liquid crystal display device is able to display an image, in which occurrence of color unevenness is suppressed, on the display area. Further, in the period in which the same color light of the backlight is emitted, the number of scanning operations for supplying the image data is only one. Therefore, it is possible to reduce the load on the display element driving circuit 40 and to secure the time period necessary for supplying image data.

Further, the light source lighting time period Tb, in which the light emitting element is turned on, is acquired. Furthermore, in order to determine the lighting start time of the light emitting element, the timing control signal is acquired. The signal is for controlling the light source lighting start time on the basis of the start time of the scanning operation for supplying color data of each light. The data for respectively displaying red images on the display area and non-display area and the light source luminance data of the light emitting element are acquired on the basis of the Xa designation data, the Xn designation data, and the field sequential image data. Thereby, in order to display an image, in which occurrence of color unevenness is suppressed, on the display area, the image display device is able to easily and reliably generate the data for red image display.

The Xa designation data and the Xn designation data are separated from the input signal including the Xa designation data and the Xn designation data by the signal separation circuit 21. In this case, at the time of generating the input signal, it is possible to easily change the Xa designation data and the Xn designation data. Hence, by changing these pieces of data, the display area capable of displaying an image, in which occurrence of color unevenness is suppressed, can be set at an arbitrary position of the liquid crystal panel 60.

The Tl designation data is included in the input signal, and is also separated by the signal separation circuit 21. Thereby, it is possible to easily change the Tl designation data. Therefore, it is possible to set the response time period Tl which is optimum for the used liquid crystal panel 60. Hence, the liquid crystal display device is able to display an image in which occurrence of color unevenness is further suppressed.

As the image data to be supplied to the non-display area, the transmission data, which is for respectively transmitting the red light, green light, and blue light at the same transmittances, is supplied. Thereby, the non-display area attains a state where the amount of transmitted light with the background color is at the maximum. Hence, an observer is able to view an object on the far side of the liquid crystal panel 60 through the non-display area.

As the image data to be supplied to the non-display area, the data, which is for minimizing the amount of transmitted light originating from the backlight unit 70, is supplied. Thereby, the light originating from the backlight unit 70 is blocked. Therefore, the non-display area, in which color unevenness occurs, is displayed in black, and the image with color unevenness is not displayed.

The light source lighting time period is acquired using the Tl designation data which indicates the response time period Tl after the image data is supplied to the liquid crystal panel 60 until the transmittance corresponding to the image data is reached. Thereby, the light source lighting time period Tb is appropriately designated, and thus an image, in which occurrence of color unevenness is further suppressed, is displayed in the display area.

The image control circuit 10 includes: the lighting ratio processing circuit 31 for acquiring the light source luminance data of the light emitting element and the light source lighting time period Tb in which the light emitting element of the backlight unit 70 is turned on; the lighting timing processing circuit 32 for acquiring the timing control signal which is for adjusting the lighting start time of the light emitting element; and the display image generation circuit 33 for acquiring the display driving data which indicates images displayed on the display area and non-display area. Thereby, the liquid crystal display device including such an image control circuit 10 is able to easily and reliably display an image, in which occurrence of color unevenness is suppressed, in the display area.

2.4 Modification Example

A configuration of a liquid crystal display device according to a modification example of the embodiment is the same as the configuration of the liquid crystal display device illustrated in FIG. 9, and thus the description thereof will be omitted.

Figure 17:
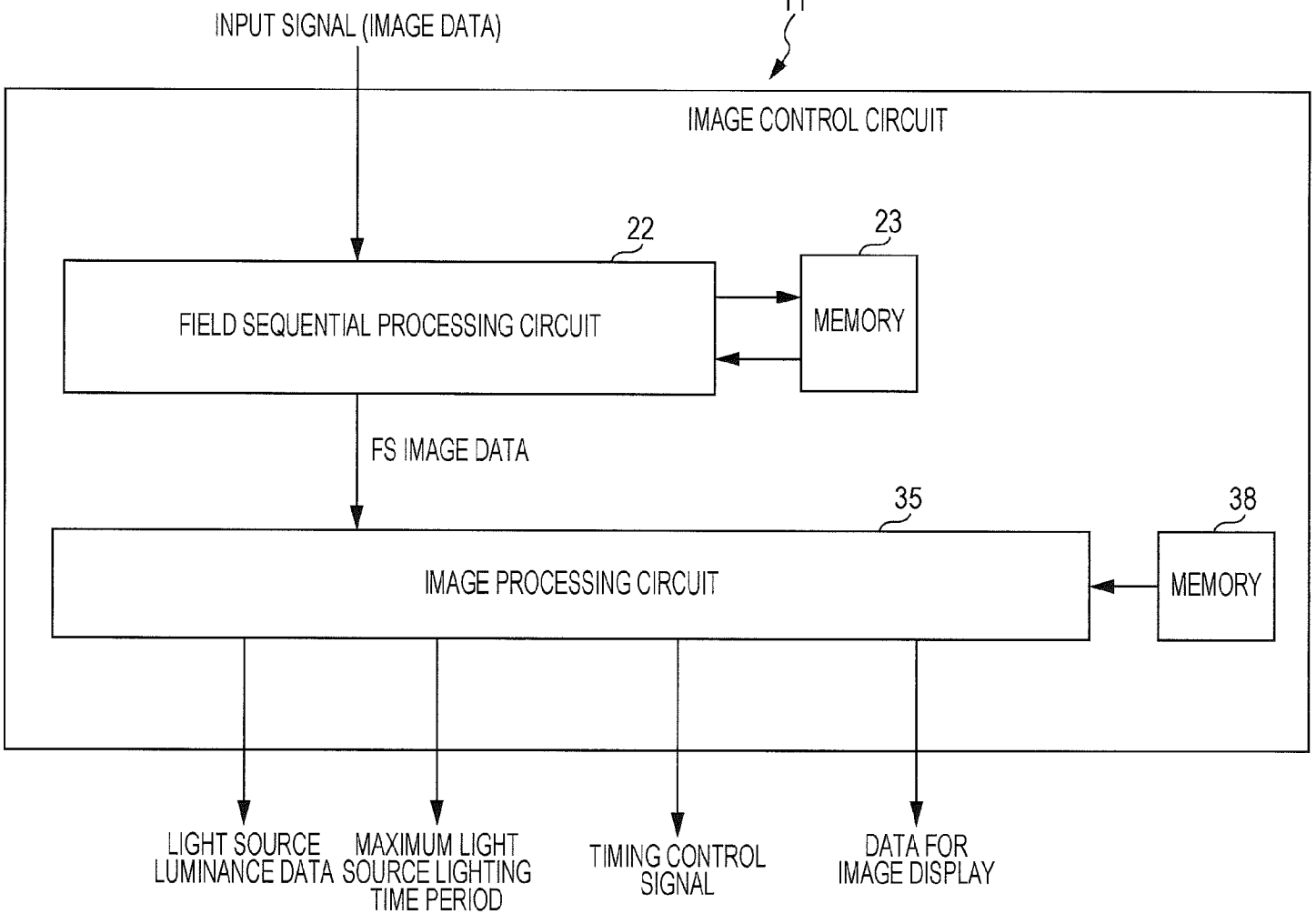
FIG. 17 is a block diagram illustrating a configuration of an image control circuit included in a liquid crystal display device according to a modification example of the first embodiment.
Figure 18:
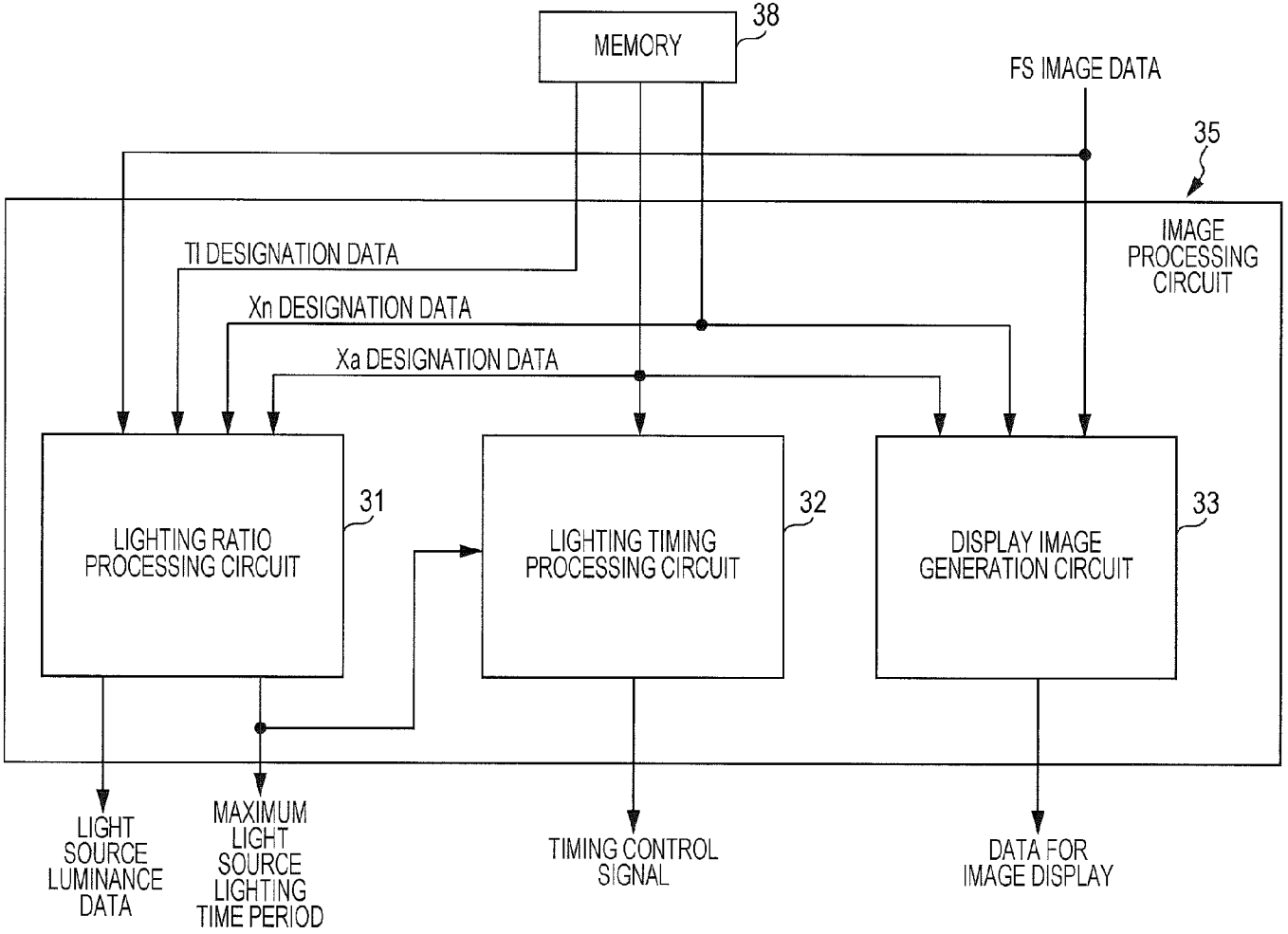
FIG. 18 is a block diagram illustrating a configuration of an image processing circuit included in the image control circuit illustrated in FIG. 17.

FIG. 17 is a block diagram illustrating a configuration of the image control circuit 31 included in the liquid crystal display device according to the modification example. FIG. 18 is a block diagram illustrating a configuration of the image processing circuit 35 included in the image control circuit 11 illustrated in FIG. 17. Among elements included in FIGS. 17 and 18, elements the same as the elements included in FIGS. 10 and 11 are represented by the same reference numerals and signs, and a description will be given centering on different elements.

Contrary to the case of FIG. 10, the input signal, which is input to the image control circuit 11 illustrated in FIG. 17, includes only the image data, and does not include the Xa designation data, the Xn designation data, and the Tl designation data. Hence, the image control circuit 11 does not include the signal separation circuit, and the input signal is directly supplied to the field sequential processing circuit 22.

Further, the memory 38 is connected to the image processing circuit 35. The memory 38 stores the Xa designation data, the Xn designation data, and the Tl designation data which are not included in the input signal. These pieces of data are read from the memory 38, and are supplied to the image processing circuit 35, as necessary.

As illustrated in FIG. 18, in a similar manner to the case of the image processing circuit 30 illustrated in FIG. 11, the image processing circuit 35 includes the lighting ratio processing circuit 31, the lighting timing processing circuit 32, and the display image generation circuit 33. The Tl designation data, the Xn designation data, and the Xa designation data are supplied from the memory 38 to the lighting ratio processing circuit 31. The Xa designation data is supplied to the lighting timing processing circuit 32. The Xn designation data and the Xa designation data are supplied to the display image generation circuit 33.

In addition, the functions of the lighting ratio processing circuit 31, the lighting timing processing circuit 32, and the display image generation circuit 33 are the same as those in the case of the first embodiment, and a description thereof will be omitted. A method of driving the liquid crystal panel 60 or driving the backlight unit 70 on the basis of the data which is output from these circuits is the same as that in the case of the first embodiment, and a description thereof will be omitted.

The present modification example has not only the same advantages as the case of the first embodiment, but also has the following unique advantages. The Xa designation data, the Xn designation data, and the Tl designation data are stored in the memory 23. Thereby, it is possible to easily change these pieces of data. Hence, by changing these pieces of data, the display area capable of displaying an image, in which occurrence of color unevenness is suppressed, can be easily set at an arbitrary position of the liquid crystal panel. 60, or the response time period Tl, which is optimum for the liquid crystal panel 60 can be easily set.

3. Second Embodiment

3.1 Configuration of Liquid Crystal Display Device

Figure 19:
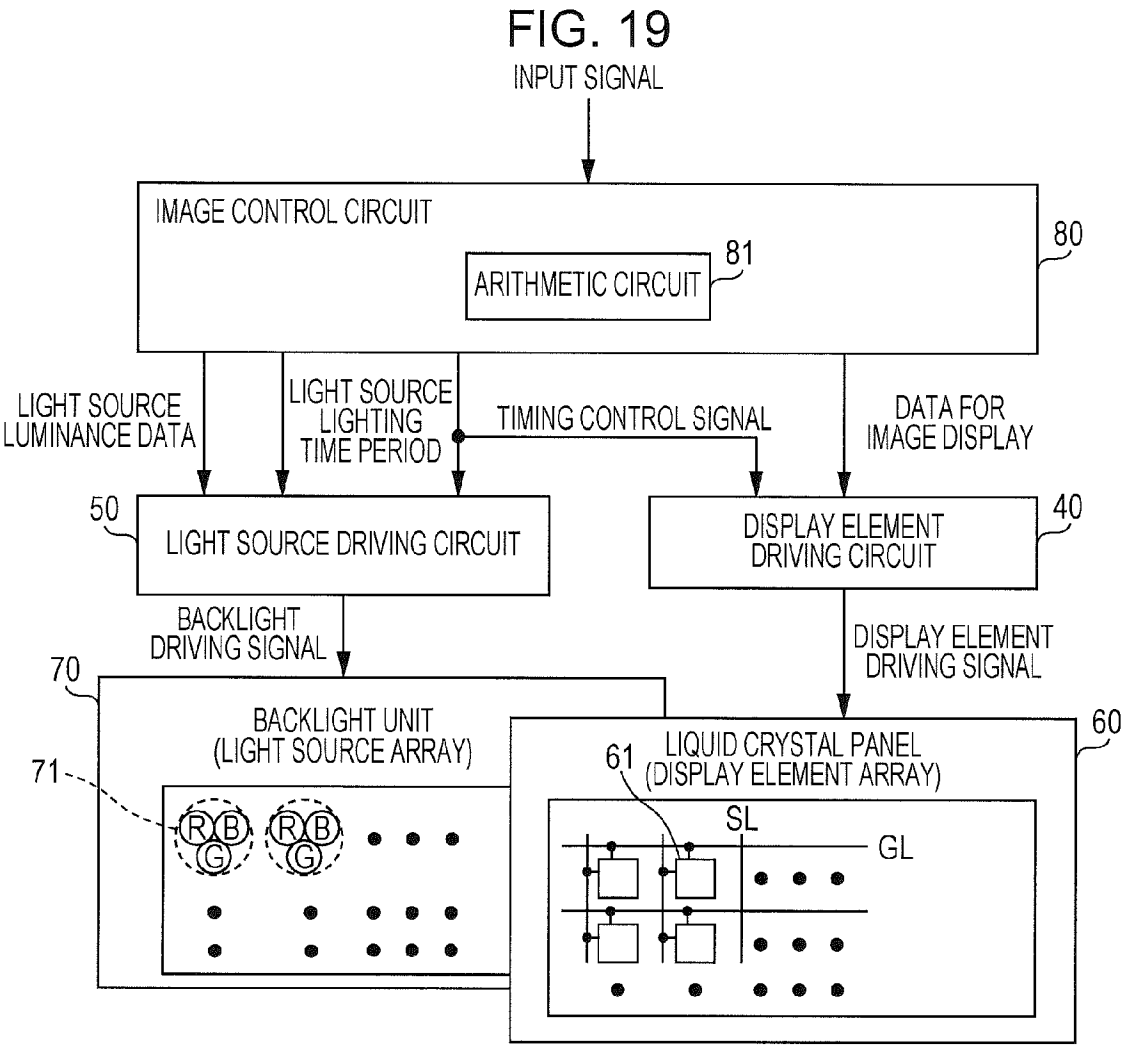
FIG. 19 is a block diagram illustrating a configuration of a liquid crystal display device according to a second embodiment of the present invention.

FIG. 19 is a block diagram illustrating a configuration of a liquid crystal display device according to a second embodiment of the present invention. As illustrated in FIG. 19, the configuration of the liquid crystal display device is the same as the configuration of the liquid crystal display device illustrated in FIG. 1. Accordingly, in FIG. 19, elements the same as the elements of the liquid crystal display device illustrated in FIG. 1 are represented by the same reference numerals and signs, a description thereof will be omitted, and different elements will be described.

An image control circuit 80 illustrated in FIG. 19 includes an arithmetic circuit 81 which is formed of a CPU, a RAM, and the like. When the input signal is supplied from the outside, on the basis of the input signal, in accordance with the flowchart to be described later, the image control circuit 80 generates the light source luminance data, the light source lighting time period Tb which is acquired on the basis of the maximum light source lighting time period Tbm, the timing control signal which is for controlling the light source lighting start time, and the data for image display. Then, the light source luminance data and the light source lighting time period Tb are supplied to the light source driving circuit 50, the timing control signal is supplied to the display element driving circuit 40 and the light source driving circuit 50, and the data for image display is supplied to the display element driving circuit 40.

It should be noted that the functions of the display element driving circuit 40, the light source driving circuit 50, the liquid crystal panel 60, and the backlight unit 70 are respectively the same as those in the case of the first embodiment, and a description thereof will, be omitted.

3.2 Operation of Image Control Circuit

Figure 20:
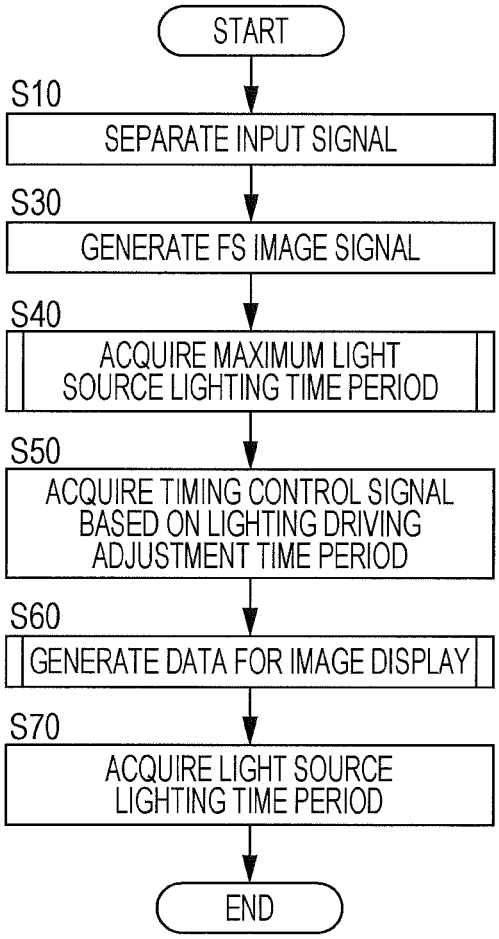
FIG. 20 is a flowchart illustrating operations of an image control circuit included in the liquid crystal display device illustrated in FIG. 19.

FIG. 20 is a flowchart illustrating operations of the image control circuit 80. In accordance with the flowchart illustrated in FIG. 20, operations of the image control circuit 80 will be described.

First, the image data included in the input signal, which is input to the image control circuit 80, the Xa designation data, the Xn designation data, and the Tl designation data are separated (step S10). Next, by using the image data, the FS image signal, which is formed of the red data, green data, and blue data, is generated (step S30).

Next, the maximum light source lighting time period Tbm is acquired on the basis of the FS image data, which is acquired in step S30, and the Xa designation signal, the Xn designation signal, and the Tl designation signal which are separated from the input signal (step S40). Step S40 is a subroutine, and a detailed description thereof will be given later.

Next, in step S50, on the basis of the maximum light source lighting time period Tbm acquired in step S40 and the Xa designation data separated from the input signal, the lighting driving adjustment time period Td for determining the lighting start time of the light source 71 is acquired, and on the basis of the lighting driving adjustment time period Td, the timing control signal is acquired.

Further, in step S60, on the basis of the FS image data acquired in step S30, the Xa designation signal, and the Xn designation signal separated from the input signal, the display start line Xa, which indicates the start position of the display area, and the non-display start line Xn, which indicates the start position of the non-display area, are acquired, and the data for respectively displaying images on these areas are acquired. Further, step S60 is a subroutine, and a detailed description thereof will be given later.

Next, in step S70, on the basis of the light source luminance data and the maximum light source lighting time period Tbm acquired in step S40, the light source lighting time period Tb corresponding to the light source luminance data is acquired, and the process ends. It should be noted that the arithmetic circuit 81 may acquire the light source lighting time period Tb, which corresponds to the light source luminance data, by using the light source driving circuit 50, without performing the process of step S70. In this case, the image control circuit 80 outputs the maximum light source lighting time period Tbm to the light source driving circuit 50.

In the present description, step S30 corresponds to means for acquiring the field sequential image data, steps S40 and S70 correspond to means for acquiring the light source lighting time period, step S50 corresponds to means for acquiring the timing control signal based on the lighting driving time period, and step S60 corresponds to means for generating the data for image display.

Figure 21:
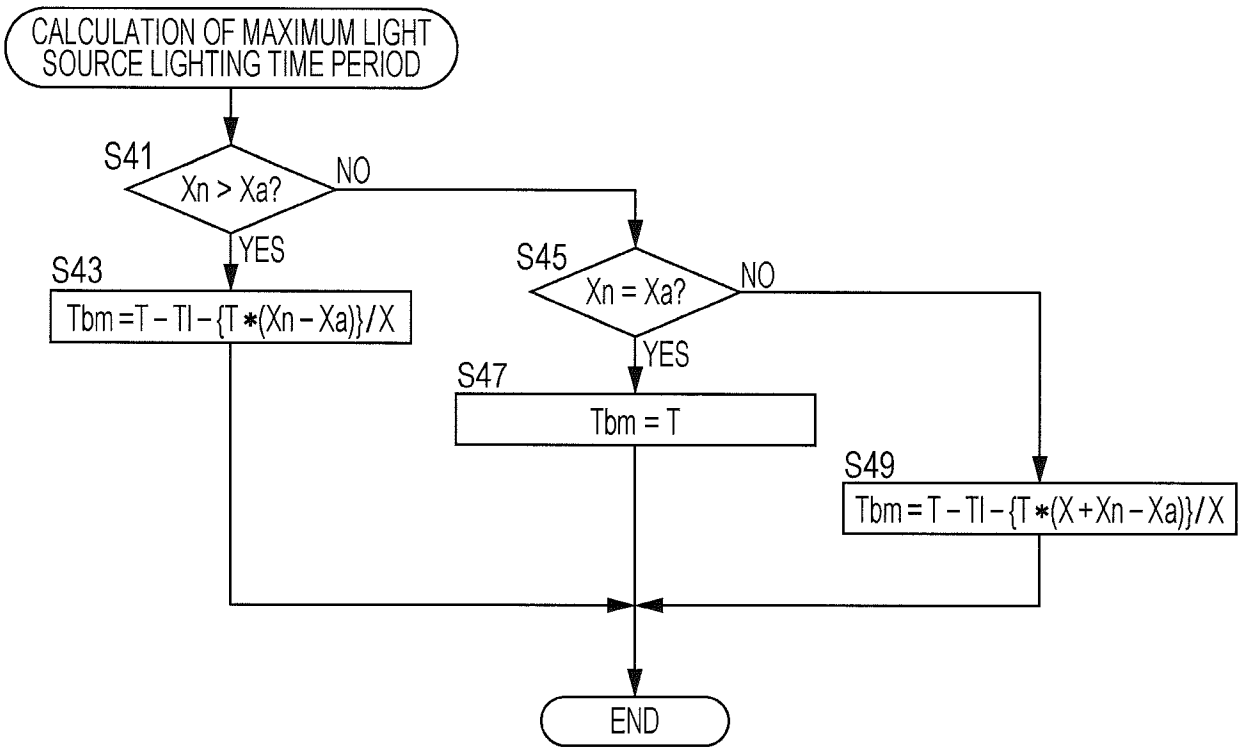
FIG. 21 is a sub-routine illustrating a processing sequence for acquiring a light source lighting time period, in the flowchart illustrated in FIG. 20.

Next, a description will be given of a processing sequence for acquiring the maximum light source lighting time period Tbm. FIG. 21 is a subroutine which indicates the processing sequence for acquiring the maximum light source lighting time period Tbm illustrated in step S40 of FIG. 20. As illustrated in FIG. 21, first, it is determined whether or not the non-display start line Xn is larger than the display start line Xa (step S41). If the determination result is positive, the process advances to step S43, the maximum light source lighting time period Tbm is acquired through an expression illustrated in step S43, and the process ends. It should be noted that the expression illustrated in step S4.3 is the same as Expression (1).

In contrast, if the determination result in step S41 is negative, the process advances to step S45. It is determined whether or not the non-display start line Xn is the same as the display start line Xa (step S45). If the determination result is positive, the process advances to step S47, the maximum light source lighting time period Tbm is acquired through an expression illustrated in step S47, and the process ends. It should be noted that the expression illustrated in step S47 is the same as Expression (2).

In contrast, if the determination result in step S45 is negative, the process advances to step S49, the maximum light source lighting time period Tbm is acquired through an expression illustrated in step S49, and the process ends. It should be noted that the expression illustrated in step S49 is the same as Expression (3). Further, in the present description, step S41 and step S45 correspond to first comparison means, and step S43, step S47 and step S49 correspond to means for calculating the light source lighting time period.

Figure 22:
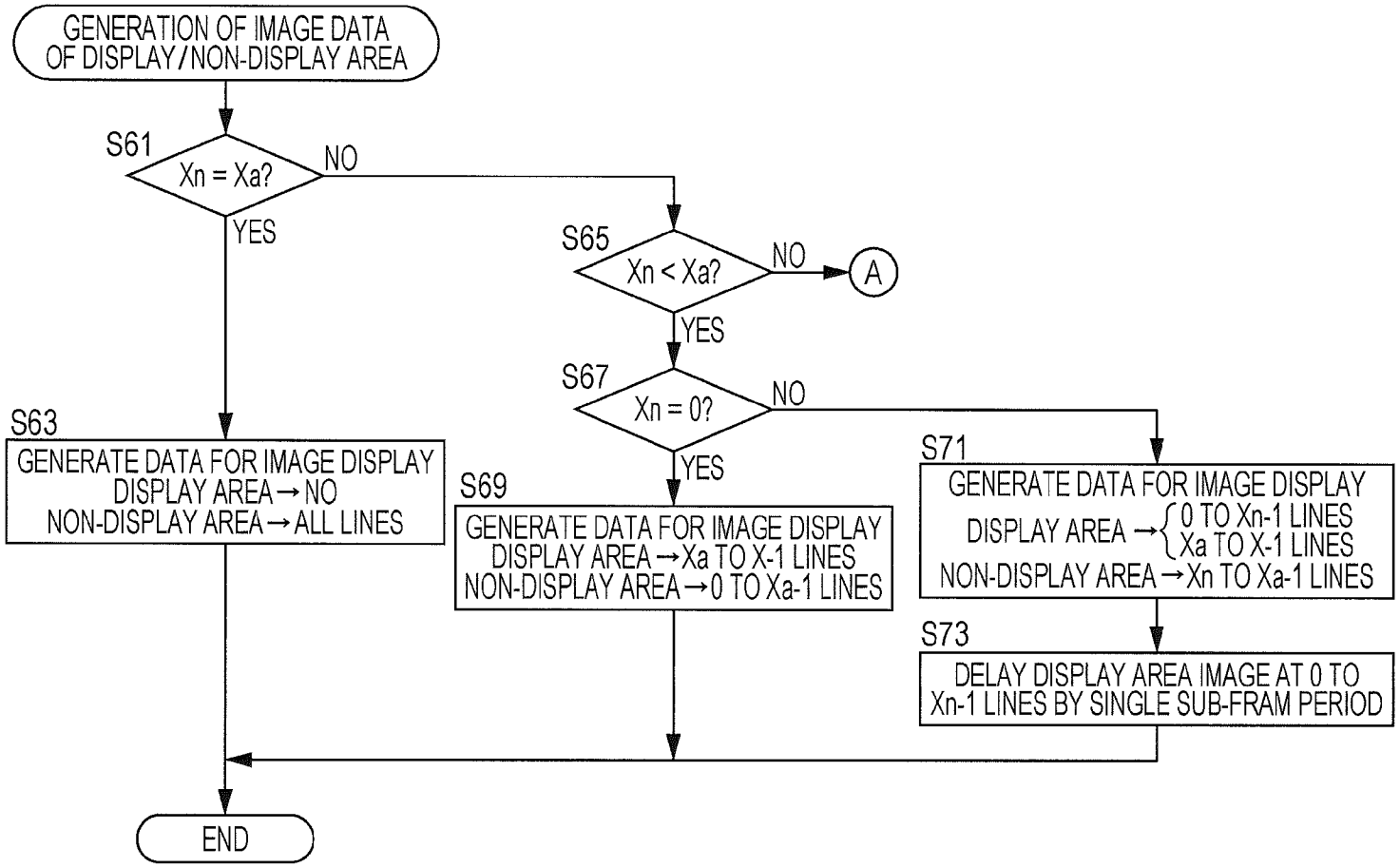
FIG. 22 is a sub-routine illustrating a processing sequence for generating data for image display, in the flowchart illustrated in FIG. 20.
Figure 23:
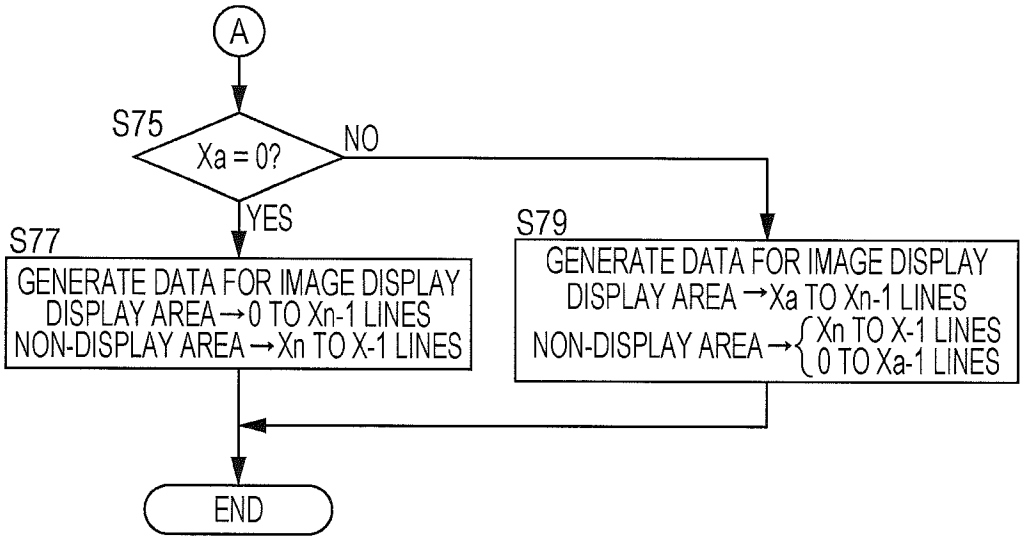
FIG. 23 is a sub-routine illustrating the processing sequence for generating data for image display, in the flowchart illustrated in FIG. 20.

Next, a description will be given of a processing sequence of generating the data for displaying images which are necessary when the images are displayed on the display area and the non-display area. FIGS. 22 and 23 are a subroutine illustrating a processing sequence of generating the data for image display in step S60 of the flowchart illustrated in FIG. 20. As illustrated in FIGS. 22 and 23, first, it is determined whether or not the non-display start line Xn is the same as the display start line Xa (step S61). If the determination result is positive, the process advances to step S63, the entire screen is set as the non-display area, the image data of the image, which is displayed in the non-display area, is generated, and the process ends. An example of a viewed image in this case is illustrated in FIG. 12.

Further, if the determination result in step S61 is negative, it is determined whether the display start line Xa is larger than the non-display start line Xn (step S65). If the determination result is positive, the process advances to step S67, and it is further determined whether or not the non-display start line Xn is zero. In step S67, if it is determined that the non-display start line Xn is zero, the Xa to X−1 lines are set as the display area, the 0 to Xa−1 lines are set as the non-display area, and the image data for performing display on each area is generated (step S69), and the process ends. An example of a viewed image in this case is illustrated in FIG. 16.

Further, in step S67, if it is determined that the non-display start line Xn is not zero, the 0 to Xn−1 lines and the Xa to X−1 lines are set as the display areas, the Xn to Xa−1 lines are set as the non-display area, and the image data for performing display on each area is generated (step S71). Furthermore, the image data of the 0 to Xn−1 lines are delayed by a single sub-frame period (step S73), and the process ends. An example of a viewed image in this case is illustrated in FIG. 14.

In step S65, if it is determined that the display start line Xa is smaller than the non-display start line Xn, the process further advances to step S75, and it is determined whether or not the display start line Xa is zero (step S75). As a result, if it is determined that the display start line Xa is zero, the 0 to Xn−1 lines are set as the display area, the Xn to X−1 lines are set as the non-display area, and the image data for performing display on each area is generated (step S77), and the process ends. An example of a viewed image in this case is illustrated in FIG. 15.

Further, in step S79, if it is determined that the non-display start line Xn is not zero, the Xa to Xn−1 lines are set as the display area, the Xn to Xn−1 lines and the 0 to Xa−1 lines are set as the non-display areas, and the image data for performing display on each area is generated (step S79), and the process ends. An example of a viewed image in this case is illustrated in FIG. 13.

As described above, on the basis of the values of the display start line Xa and the non-display start line Xn and such a magnitude relationship therebetween, the screen is divided into the display area and the non-display area, and the image data for performing display on each area is generated. In addition, in the present description, steps S61, S65, S67, and S75 correspond to second comparison means, steps S63, S69, S71, S73, S77, and S79 correspond to means for specifying a display position of an image and the sub-frame period for image display, and step S73 corresponds to means for displaying an image with a delay.

3.3 Advantages

The second embodiment has not only the same advantages as the case of the first embodiment, but also may have the following unique advantages. The maximum light source lighting time period Tbm is calculated from any one of Expressions (1) to (3), on the basis of the magnitude relationship between the Xa designation data and the Xn designation data, whereby the light source lighting time period Tb can be easily and promptly acquired, on the basis of the maximum light source lighting time period Tbm. Thereby, the liquid crystal display device is able to easily and promptly display an image with no color unevenness in the display area.

Further, by comparing magnitudes of the Xa designation data and the Xn designation data, the display position and the image data for performing display on each of the display area and non-display area are easily and promptly designated. Thereby, the liquid crystal display device is able to easily and promptly display an image with no color unevenness in the display area.

3.4 Modification Example

Figure 24:
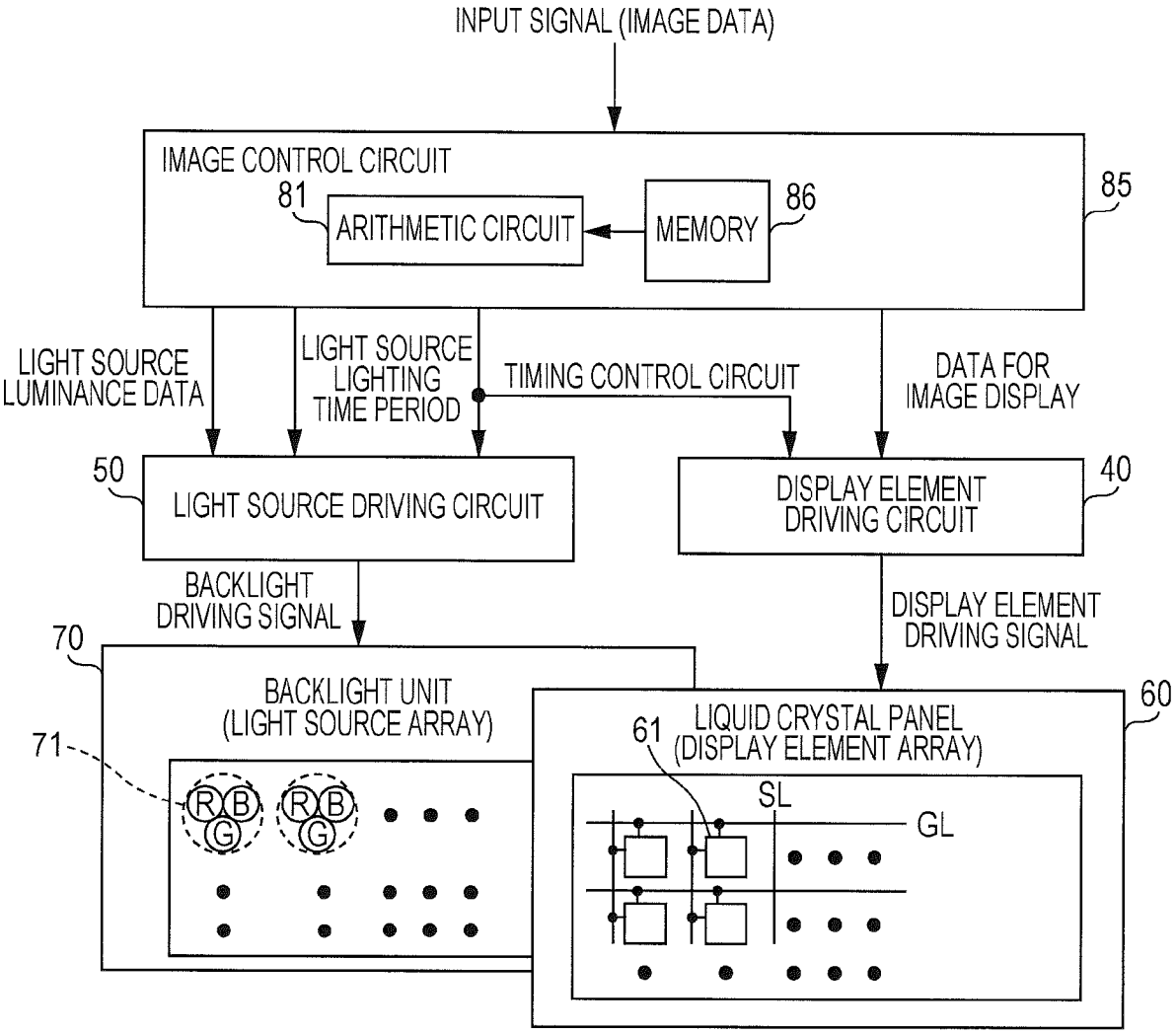
FIG. 24 is a block diagram illustrating a configuration of a liquid crystal display device according to a modification example of the second embodiment of the present invention.

FIG. 24 is a block diagram illustrating a configuration of a liquid crystal display device according to a modification example of the second embodiment of the present invention. As illustrated in FIG. 24, the configuration of the liquid crystal display device is the same as the configuration of the liquid crystal display device illustrated in FIG. 1. Accordingly, in FIG. 24, elements the same as the elements of the liquid crystal display device illustrated in FIG. 1 are represented by the same reference numerals and signs, a description thereof will be omitted, and different elements will be described.

An image control circuit 85 included in the liquid crystal display device illustrated in FIG. 24 includes the arithmetic circuit 81 which is formed of a CPU, a RAM, and the like, and a memory 86 which is connected to the arithmetic circuit 81. When the input signal is supplied from the outside, on the basis of the input signal, the image control circuit 85 acquires the maximum light source lighting time period Tbm, the timing control signal, and the data for image display. Furthermore, on the basis of the maximum light source lighting time period Tbm, the light source lighting time period Tb is acquired. Contrary to the input signal illustrated in FIG. 19, the input signal of the modification example includes only the image data, and does not include the Xa designation data, the Xn designation data, and the Tl designation data.

Figure 25:
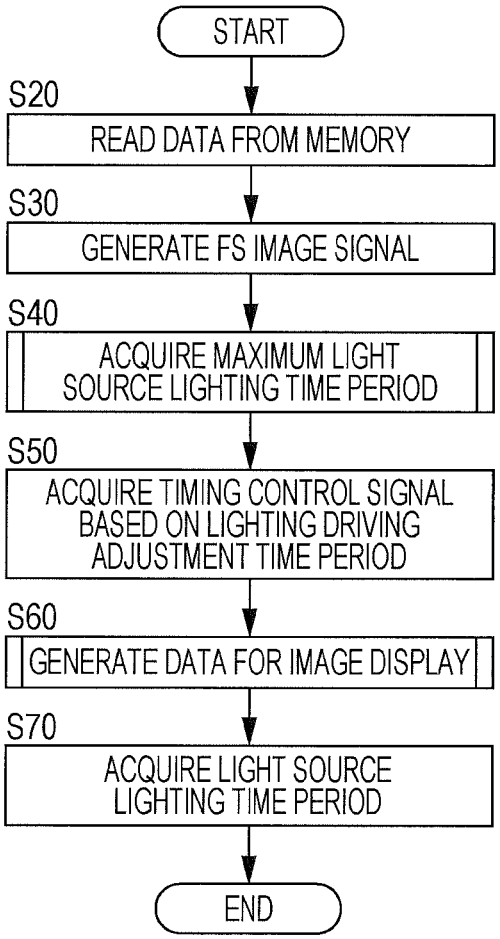
FIG. 25 is a flowchart illustrating operations of an image control circuit included in the liquid crystal display device illustrated in FIG. 24.

Accordingly, the Xa designation data, the Xn designation data, and the Tl designation data, which are not included in the input signal, are stored in the memory 86 connected to the arithmetic circuit 81. The arithmetic circuit 81 reads necessary data from the memory 86, and performs calculation. FIG. 25 is a flowchart illustrating operations of the image control circuit 85. In the flowchart illustrated in FIG. 25, contrary to the flowchart illustrated in FIG. 20, instead of step S10, step S20 is provided. In step S20, the Xa designation data, the Xn designation data, and the Tl designation data, which are not included in the input signal, are read from the memory 86. In addition, in each of steps S40 and S60 of the flowchart illustrated in FIG. 25, calculation is performed in accordance with the subroutine illustrated in FIGS. 21 to 23.

The image control circuit 85 outputs the light source lighting time period Tb, which is acquired in such a manner, to the light source driving circuit 50, outputs the timing control signal to the light source driving circuit 50 and the display element driving circuit 40, and outputs the data for image display to the display element driving circuit 40. Thereby, the display area capable of displaying an image with no color unevenness on the liquid crystal panel 60 is formed.

The present modification example has unique advantages the same as the advantages of the modification example of the first embodiment, and a description thereof will be omitted.

4. Third Embodiment

Next, application examples of the present invention will be described.

4.1 First Application Example

Figure 26:
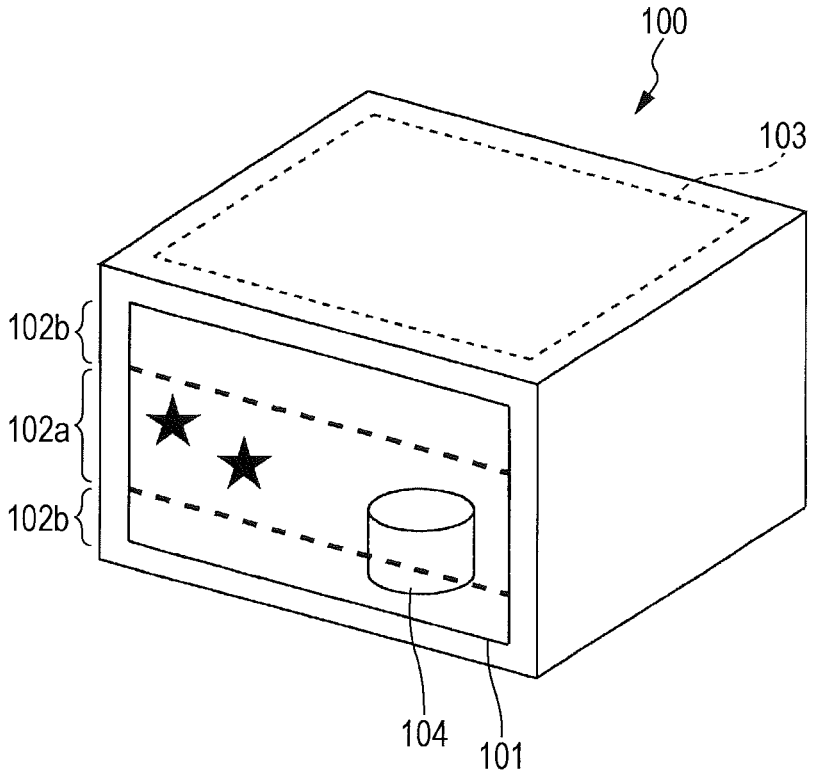
FIG. 26 is a perspective view illustrating a presentation box which is a first application example of the present invention.

FIG. 26 is a perspective view illustrating a presentation box 100 which is a first application example of the present invention. As illustrated in FIG. 26, the presentation box 100 is configured such that an observer is able to observe an exhibited object 104, which is exhibited inside, through a liquid crystal panel 101 which is provided on the front side of the presentation box 100.

A backlight unit 103, which emits each of red light, green light, and blue light, is provided on the top of the presentation box 100.

It should be noted that, in the presentation box 100 illustrated in FIG. 26, the backlight unit 103 is provided on the top thereof. However, the position at which the backlight unit 103 is provided is not limited to the top surface, and may be anywhere inside the box. Further, the backlight unit 103 is not limited to the light emitting elements respectively emitting red light, green light, and blue light, and may be light emitting elements respectively emitting light of one or more colors.

Further, it is preferable that light originating from the backlight unit 103 be diffused in accordance with a certain method. Specifically, for example, it may be possible to adopt the following configurations: light of the LED disposed on the top is diffused by setting the color of the inner surface of the box as white so as to diffusely reflect the illumination light, and the diffusion light is transmitted from the rear surface of the liquid crystal panel 101; light of the LED disposed at an arbitrary position is diffused through a diffuser plate or film, a lens, or the like, and the diffusion light is transmitted from the rear surface of the liquid crystal panel 101; and the LED is disposed on the side surface of the panel, and the diffusion light is transmitted from the rear surface of the liquid crystal panel 101 by using a light guide plate or the like.

The red, green, and blue light emitting elements are sequentially turned on, and the red light, green light, and blue light are sequentially emitted in the presentation box 100. In synchronization with the timing of turning on each light emitting element, the image data is supplied to the liquid crystal panel 101. Thereby, as described in the first embodiment, a display area 102*a*, which is capable of displaying an image with no color unevenness on the liquid crystal panel 101, is provided. In the display area 102*a*, two star-shaped images are displayed, and the display area 102*a* excluding the star-shaped images is in the state where the amount of transmitted light with the background color is at the maximum. It should be noted that, instead of the star-shaped images, a description of the exhibited object 104, which is exhibited inside the box, may be displayed.

Further, in the liquid crystal panel 101, non-display areas 102*b* are provided with the display area 102*a* interposed therebetween in the vertical direction. The non-display areas 102*b* are also in the state where the amount of transmitted light with the background color is at the maximum. Thereby, an observer is able to view the exhibited object 104 through the display area 102*a* other than the star-shaped images and non-display areas 102*b*. Further, an image with no color unevenness can be displayed on the display area 102*a*.

In addition, in the first application example, the image data is supplied to the liquid crystal panel 101 such that the display area 102*a* is provided in the middle of the liquid crystal panel 101 and the non-display areas 102*b* are provided with the display area 102*a* interposed therebetween in the vertical direction. However, the positions of the display area 102*a* and the non-display areas 102*b* are not limited to this, and can be set at arbitrary positions on the liquid crystal panel 101. Further, the non-display area is an area in the maximum transmission state, but may be an area in which liquid crystal does not react in accordance with the image data. Specifically, the non-display area may be an area in which light originating from the backlight unit 103 is not transmitted, a semi-transparent area in which only a part of the light of the backlight unit 103 is transmitted, and an area in which a non-color image (monochrome image) is displayed.

As described above, when the non-display area is set as an area in the maximum transmission state, it becomes easy for an observer to see the entire inside of the presentation box 100 including the exhibited object 104. Further, when the non-display area is set as an area in which light originating from the backlight unit 103 is not transmitted, light of the background may be blocked. Further, in accordance with combination thereof, only the exhibited object 104 may be made to be easily seen.

In addition, in the presentation box 100, the LED provided on the top also serves as a light source for illuminating the exhibited object 104 inside the box. However, a different light source may be provided to illuminate the exhibited object 104.

Further, the liquid crystal panel 101 used in the presentation box 100 may employ either a normally black panel, in which light is blocked at the time of non-application of power supply, or a normally white panel in which light is transmitted at the time of non-application of power supply. In addition, from the viewpoint of suppressing power consumption, when the exhibited object 104 inside the box is intended to be viewed even at the time of non-application of power supply, it is preferable to use the normally white panel. Further, from the viewpoint of security or the like, when light is intended to be blocked at the time of non-application of power supply, it is preferable to use the normally black panel.

Further, by decreasing the depth of the presentation box, the box can be applied to a frame with glass for exhibiting a picture, a photo, or the like. The glass is a color-filterless liquid crystal panel. Therefore, when a picture or a photo is intended to be appreciated, the entire surface of the liquid crystal panel is set as the non-display area which is in the maximum transmission state. In addition, when a video is intended to be displayed on the liquid crystal panel, the entire surface is set as the display area. Furthermore, when a higher image quality video is intended to be displayed, it is preferable that a white screen, which is for diffusely reflecting the illumination light, be disposed between the liquid crystal panel and a picture or the like. It should be noted that the display area and the non-display area may be combined, and a video display device may be provided instead of a picture or a photo.

It is not indispensable for the presentation box to have a cube shape or a rectangular parallelepiped shape in which there are six surfaces, and it may have a shape in which some of these surfaces are not present, or may be a spherical shape or a shape other than that.

4.2 Second Application Example

Figure 27:
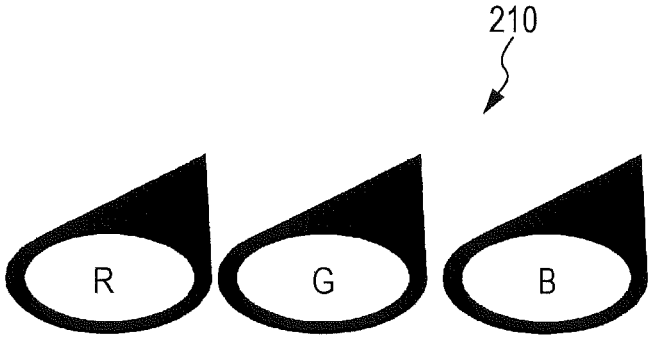
FIG. 27 is a diagram illustrating a light source that emits light of a plurality of colors used in a second application example of the present invention. More specifically, FIG. 27(*a*) illustrates an indoor illumination unit of which a plurality of light emitting elements are sequentially turned on, and FIG. 27(*b*) illustrates a display device that is driven in the field sequential method.
Figure 27:
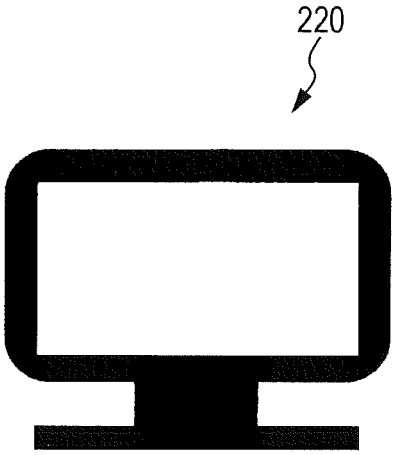

FIG. 27 is a diagram illustrating a light source that emits light of a plurality of colors used in a second application example of the present invention. More specifically, FIG. 27(*a*) illustrates an indoor illumination unit 210 of which a plurality of light emitting elements are sequentially turned on, and FIG. 27(*b*) illustrates a television 220 that is driven in the field sequential method. Further, FIG. 28 is a diagram illustrating the second application example of the present invention. More specifically, FIG. 28(*a*) illustrates glasses 230 as an application of the present invention, and FIG. 28(*b*) illustrates a tablet 240 as an application of the present invention.

As an indoor light source, for example, the illumination unit 210, which sequentially emits red light, green light, and blue light for predetermined time periods, is used as illustrated in FIG. 27(*a*), or the television 220 which is driven in the field sequential method is used as illustrated in FIG. 27(*b*). In this case, the television 220 functions as, for example, a light source that sequentially emits red light, green light, and blue light.

In such an indoor environment, an observer is able to enjoy an image, which is displayed on a lens 231 of such glasses 230 as illustrated in FIG. 28(*a*), by wearing the glasses 230. Specifically, by using the liquid crystal panel described in the first or second embodiment of the present invention as the lens 231 of the glasses 230, the display area capable of displaying an image with no color unevenness can be provided on the lens 231. In this case, an observer, who wears the glasses 230, is able to enjoy an image which is displayed in the display area of the lens 231.

Further, an observer is able to enjoy an image which is displayed on the tablet 240 illustrated in FIG. 28(*b*) by holding the tablet 240 by the hands. Specifically, by using the liquid crystal panel described in the first or second embodiment of the present invention as the display panel 241 of the tablet 240, the display area capable of displaying an image with no color unevenness can be provided on the display panel 241. In this case, an observer, who holds the tablet 240 by the hands, is able to enjoy an image which is displayed in the display area of the display panel 241.

5. Others

In the description of each embodiment, the liquid crystal panel is illuminated with light of the backlight, which has any one of red, green, and blue colors, in each sub-frame period. However, in a single sub-frame period, light of the backlight with a plurality of colors may be emitted onto the liquid crystal panel at the same time. Specifically, as described in Japanese Unexamined Patent Application Publication No. 2002-318564, in the respective sub-frame periods, color light of the backlight may be emitted onto the liquid crystal panel in an order of red light, green light, blue light, and white light (lighting of the red light, green light, and blue light of the backlight light sources at the same time). Further, as described in Japanese Unexamined Patent Application Publication No. 2009-134156, red light and blue light of the backlight light source may be emitted at the same time in the first sub-frame period, red light, green light, and blue light of the backlight light source may be emitted at the same time in the second sub-frame period, and blue light of the backlight light source may be emitted in the third sub-frame period.

As the liquid crystal used in the liquid crystal display device, it may also be possible to employ polymer dispersed liquid crystal (PDLC) using a thin film in which liquid crystal is dispersed in polymer molecules. Further, in the description of each embodiment, the liquid crystal display device is an example, but the present invention is not limited to this, and may also be applied to a different image display device such as an organic electro luminescence (EL) display device.

REFERENCE SIGNS LIST

10, 11, 80: IMAGE CONTROL CIRCUIT
21: SIGNAL SEPARATION CIRCUIT
22: FIELD SEQUENTIAL CIRCUIT
30, 35: IMAGE PROCESSING CIRCUIT
31: LIGHTING RATIO PROCESSING CIRCUIT
32: LIGHTING TIMING PROCESSING CIRCUIT
33: DISPLAY IMAGE GENERATION CIRCUIT
38, 86: MEMORY
40: DISPLAY ELEMENT DRIVING CIRCUIT
50: LIGHT SOURCE DRIVING CIRCUIT
81: ARITHMETIC CIRCUIT
60, 101: LIQUID CRYSTAL PANEL
61: PIXEL
70, 103: BACKLIGHT UNIT
71: LIGHT SOURCE
100: PRESENTATION BOX

The invention claimed is:

1. An image display device to display an image with a desired color by dividing a single frame period of a supplied input signal into a plurality of sub-frame periods and sequentially performing a scanning operation on single or multiple color data for each sub-frame period, the image display device comprising:

a display panel, including a display area to display the image with the desired color upon receiving the single or multiple color data generated based on the input signal, for each sub-frame period, and including a non-display area on which an image including a color other than the desired color is displayable;

an illumination unit to emit single or multiple color light of a backlight generated based on light source luminance data, from a rear surface side of the display panel for each sub-frame period; and an image control circuit to generate the single or multiple color data based on the input signal and to acquire a light source lighting time period, by which a lighting time period of the illumination unit is designatable, and a timing control signal for controlling at least one of a lighting start time of the illumination unit and a start time of the scanning operation, wherein the image control circuit is configured to supply the single or multiple color data to the display panel by performing the scanning operation for each sub-frame period, to control the light source lighting time period of the illumination unit configured to emit the single or multiple color light of the backlight corresponding to the single or multiple color data, for each of periods corresponding to periods, in which only the single or multiple color data necessary for display of the image with the desired color is supplied, in the sub-frame periods, and to control at least one of the lighting start time of the illumination unit and the start time of the scanning operation, wherein the single or multiple color data supplied to the non-display area for each sub-frame period is data which is the same for each pixel, and wherein the image control circuit includes a field sequential processing circuit to generate field sequential image data for displaying an image for each sub-frame period by using the single or multiple color data included in the input signal, a lighting ratio processing circuit to acquire the light source lighting time period, by which a lighting time period of the illumination unit is designated, and the light source luminance data of the light of the backlight, based on display start position designation data for designating a display start position of the display area and non-display start position designation data for designating a display start position of the non-display area, a lighting timing processing circuit to acquire the timing control signal for controlling at least one of the lighting start time of the illumination unit and the start time of the scanning operation, based on the light source lighting time period and the display start position designation data, and a display image generation circuit to generate the single or multiple color data to be supplied to each of the display area and the non-display area, based on the field sequential image data, the display start position designation data, and the non-display start position designation data.

2. The image display device according to claim 1, wherein the scanning operation is at least one of a scanning operation, which starts later than the start time of the sub-frame period, and a scanning operation which ends earlier than the end time of the sub-frame period.

3. The image display device according to claim 1, wherein when response time period designation data is supplied, the image control circuit is configured to acquire the light source lighting time period by further using the response time period designation data, where the response time period designation data indicates a time period until transmittance corresponding to the single or multiple color data is reached after the single or multiple color data is supplied.

4. The image display device according to claim 1, wherein the image control circuit is configured to acquire the single or multiple color data to be supplied to each of the display area and the non-display area, based on field sequential image data for displaying an image for each sub-frame period based on the input signal, display start position designation data for designating a display start position of the display area, and non-display start position designation data for designating a display start position of the non-display area.

5. The image display device according to claim 1, wherein the input signal further includes the display start position designation data and the non-display start position designation data, wherein the image control circuit further includes a signal separation circuit which is connected to the field sequential processing circuit, the lighting ratio processing circuit, the lighting timing processing circuit, and the display image generation circuit, and wherein the signal separation circuit is configured to separate the single or multiple color data, the display start position designation data, and the non-display start position designation data, from the input signal.

6. The image display device according to claim 5, wherein the input signal further includes response time period designation data which indicates a time period until transmittance corresponding to the single or multiple color data is reached after the single or multiple color data is supplied to the display panel, wherein the signal separation circuit is further to separate the response time period designation data from the input signal and supply the response time period designation data to the lighting ratio processing circuit, and wherein the lighting ratio processing circuit is configured to acquire the light source lighting time period by using the display start position designation data, the non-display start position designation data, and the response time period designation data.

7. The image display device according to claim 1, wherein the image control circuit further includes a memory which is connected to the lighting ratio processing circuit, the lighting timing processing circuit, and the display image generation circuit, and which is configured to store the display start position designation data and the non-display start position designation data, wherein the lighting ratio processing circuit is configured to read the display start position designation data and the non-display start position designation data from the memory in order to acquire the light source lighting time period, wherein the lighting timing processing circuit is configured to read the display start position designation data from the memory in order to acquire the timing control signal, and wherein the display image generation circuit is configured to read the display start position designation data and the non-display start position designation data from the memory in order to generate the single or multiple color data to be supplied to each of the display area and the non-display area.

8. The image display device according to claim 7, wherein the memory further is configured to store response time period designation data which indicates a time period until transmittance corresponding to the single or multiple color data is reached after the data for displaying a single or multiple color image is supplied, and wherein the lighting ratio processing circuit is configured to read the display start position designation data, the non-display start position designation data, and the response time period designation data, from the memory, and is configured to acquire the light source lighting time period.

9. The image display device according to claim 1, wherein the image control circuit includes means for acquiring field sequential image data for displaying an image for each sub-frame period, based on the input signal, means for acquiring at least one of the light source lighting time period, by which a lighting time period of the illumination unit is designated, and the light source luminance data of the light of the backlight, based on display start position designation data for designating a display start position of the display area, non-display start position designation data for designating a non-display start position of the non-display area, and the field sequential image data, means for acquiring the timing control signal for controlling at least one of the lighting start time of the illumination unit and the start time of the scanning operation, based on the display start position designation data and the light source lighting time period, and means for generating the single or multiple color data, based on the field sequential image data, the display start position designation data, and the non-display start position designation data.

10. The image display device according to claim 9, wherein the means for acquiring the light source lighting time period includes first comparison means for comparing magnitudes of the display start position designation data and the non-display start position designation data, and means for calculating the light source lighting time period through a calculation expression in accordance with a comparison result obtained by the comparison means.

11. The image display device according to claim 9, wherein the means for generating the single or multiple color data includes second comparison means for comparing magnitudes of the display start position designation data and the non-display start position designation data, and means for specifying a display position of the image by generating the single or multiple color data to be supplied to each of the display area and the non-display area, based on a comparison result obtained by the second comparison means.

12. The image display device according to claim 11, further comprising means for displaying the image in a delayed manner, wherein when the non-display start position designation data is smaller than the display start position designation data and is not zero, the means for displaying the image in a delayed manner outputs the single or multiple color data, which has the display start position designation data smaller than the non-display start position designation data, with a delay of a single sub-frame period.

13. A presentation box comprising the image display device according to claim 1.

* * * * *